US005560739A

United States Patent [19]

Kunito

[11] Patent Number: 5,560,739

[45] Date of Patent: Oct. 1, 1996

[54] METHOD OF FORMING A MODIFIED GROUND IN AN EARTHEN FOUNDATION

[75] Inventor: Mitsuhiro Kunito, Kishiwada, Japan

[73] Assignee: Kabushiki Kaisha Ask Kenkyusho, Osaka, Japan

[21] Appl. No.: 242,671

[22] Filed: May 13, 1994

[30] Foreign Application Priority Data

| | | | |
|---|---|---|---|
| Nov. 16, 1993 | [JP] | Japan | 5-287101 |
| Nov. 16, 1993 | [JP] | Japan | 5-287102 |
| Dec. 14, 1993 | [JP] | Japan | 5-313851 |
| Dec. 14, 1993 | [JP] | Japan | 5-313852 |

[51] Int. Cl.[6] ..... E02D 3/12

[52] U.S. Cl. ..... 405/237; 405/232; 405/269

[58] Field of Search ..... 405/266, 269, 405/264, 240, 241, 242, 267; 299/16, 17

[56] References Cited

U.S. PATENT DOCUMENTS

| | | | |
|---|---|---|---|
| 3,802,203 | 4/1974 | Ichise et al. | 405/264 |
| 3,969,902 | 7/1976 | Ichise et al. | 405/266 X |
| 4,212,565 | 7/1980 | Watabe . | |
| 4,566,825 | 1/1986 | Hirai et al. . | |
| 4,659,259 | 4/1987 | Reed et al. . | |
| 4,832,535 | 5/1989 | Crambes | 405/266 |
| 5,141,366 | 8/1992 | Ishida et al. | 405/266 X |
| 5,163,784 | 11/1992 | Kunito | 405/266 X |
| 5,304,016 | 4/1994 | Kunito . | |

FOREIGN PATENT DOCUMENTS 59-16049 4/1984 Japan .

*Primary Examiner*—Dennis L. Taylor

*Attorney, Agent, or Firm*—Armstrong, Westerman, Hattori, McLeland & Naughton

[57] ABSTRACT

A modified ground for an underground water cut-off wall, landslide protection wall, or a foundation pile, etc., is formed in an earthen foundation by an excavator having at least one rotary shaft in accordance with the following method. The rotary shaft includes a bit on a lower end thereof and at least one nozzle for jetting a consolidating fluid which is disposed upwardly of the bit. The method comprises an excavating step for forming a hole in the earthen foundation and a withdrawing step of the rotary shaft from the hole. That is, in the excavating step, the rotary shaft is advanced into the earthen foundation to form therein the hole while rotating the rotary shaft without jetting the consolidating fluid from the nozzle until the hole is excavated to reach a predetermined depth. Subsequently, in the withdrawing step, the rotary shaft is withdrawn away from the bottom of the hole while rotating the rotary shaft and jetting the consolidating fluid from the nozzle against soil surrounding the hole for enlarging the diameter of the hole in such a manner as to perform an in-situ mixing and stirring of the consolidating fluid and soil. After the resulting mixture is hardened, the modified ground having a larger diameter than the hole is formed in the earthen foundation.

12 Claims, 21 Drawing Sheets

2
50
17
14
13

2
50
17
14
13

2
50
17
16
15

2
16
51
15

51

2
50
17
14
13
60

2
50
17
14
13
60

2
50
17
51
60

2
17
51
60

2F
50F
2F
50F
17F
70F
71F
14F
14F
13F 50F
53F
P
50F 2F
17F
70F
71F
15F
13F
71F
16F
13F
51F 53F
50F
50F
51F

51F
D

METHOD OF FORMING A MODIFIED GROUND IN AN EARTHEN FOUNDATION

BACKGROUND OF THE INVENTION

1. Field of the Invention

The present invention relates to a method of forming in an earthen foundation a modified ground which is used for an underground water cut-off wall, landslide protection wall, or a foundation pile in the earthen foundation, and for reinforcing a soft earthen foundation.

2. Disclosure of the Prior Art

Japanese Patent Early Publication No. 04-299558 discloses a method of forming a pillar in an earthen foundation. The method uses an excavator with an augur shaft having a bit for excavating the earthen foundation, a spiral screw and nozzles for jetting a consolidating fluid. The method comprises the steps of excavating the earthen foundation with the bit to form therein a hole while rotating the augur shaft and jetting the consolidating fluid from the nozzles until the hole reaches to a predetermined depth, and withdrawing the augur shaft from the hole. As a result, the hole is filled with a mixture of the consolidating fluid and the excavated soil. After a solidification of the mixture, the pillar is formed in the earthen foundation. A diameter of the pillar is substantially equal to a diameter of gyration of the spiral screw of the augur shaft. Therefore, the jetting of the consolidating fluid in the excavating step is useful for performing an in-situ stirring and mixing of the excavated soil and the consolidating fluid without varying the diameter of the hole. Of course, it is possible that the prior method is repeated to construct an underground water cut-off wall or landslide protection wall in the earthen foundation.

By the way, as a huge structure is constructed in or on the earthen foundation, a method of forming a thick pillar or long pillar is desired. For example, it would be readily proposed by one of ordinary skill in the art that the thick pillar is formed by the use of an excavator having a thick augur shaft. However, since such an excavator needs a powerful and expensive driving device for rotating the thick augur shaft, it would cause an excess construction cost of the thick pillar as a whole. In addition, since the augur shaft always receives a contacting pressure between the bit and the earthen foundation during the excavating step, there is a problem that the augur shaft can be accidentally advanced into the earthen foundation along an inclined axis with respect to the earthen foundation, so that an inclined hole would be formed in the earthen foundation. Subsequently, in the withdrawing step, the augur shaft is withdrawn away from the inclined hole without modifying a vertical accuracy of the inclined hole. Therefore, in accordance with the prior method, it would be difficult to form a modified ground pillar having an improved vertical accuracy thereof in the earthen foundation.

SUMMARY OF THE INVENTION

For solving the above problems, the present invention is directed to a method of forming a thick modified ground pillar or wall having an improved vertical accuracy thereof in an earthen foundation. The present method uses an excavator having at least one rotary shaft which includes a bit on the lower end thereof and a nozzle for jetting a consolidating fluid. The nozzle is disposed upwardly of the bit. The present method comprises the steps of excavating the earthen foundation with the bit to form therein a hole by rotating the rotary shaft without jetting the consolidating fluid from the nozzle until the hole is excavated to reach a predetermined depth, and then withdrawing the rotary shaft away from the bottom of the hole while rotating the rotary shaft and jetting the consolidating fluid from the nozzle against soil surrounding the hole to break the soil for enlarging the diameter of the hole in such a manner as to perform an in-situ stirring and mixing of the consolidating fluid and the soil. After a solidification of the mixture, the thick modified ground pillar having a larger diameter than the excavated hole is formed in the earthen foundation without using an expensive excavator with a thick rotary shaft. Of course, it is possible to repeat the present method to construct an underground water cut-off wall, or landslide protection wall, etc., in the earthen foundation. By the way, it is a very important step of the present method to jet the consolidating fluid from the nozzle during the withdrawing step. For example, in the excavating step, the rotary shaft can be accidentally advanced into the earthen foundation along an inclined axis with respect to the earthen foundation by a contacting pressure between the bit and the earthen foundation, so that an inclined hole is formed. However, in the withdrawing step, since the contacting pressure is released from the rotary shaft, and the soil surrounding the inclined hole is softened by the jetting of the consolidating fluid from the nozzle, a recovering force of the rotary shaft in the inclined hole effectively works such that the rotary shaft has a vertical axis with respect to the earthen foundation immediately after starting the withdrawing step. Therefore, the vertical accuracy of the modified ground pillar can be improved during the withdrawing step. On the other hand, in case that the rotary shaft is advanced into the earthen foundation along the inclined axis while jetting the consolidating fluid from the nozzle, the soil surrounding the rotary shaft can be softened. However, since the bit of the rotary shaft always receives the contacting pressure, a modified ground pillar having an inclined axis thereof would be merely formed in the earthen foundation.

Therefore, it is a primary object of the present invention to provide a method of forming in an earthen foundation a modified ground having an improved vertical accuracy thereof.

In a preferred embodiment of the present invention, the nozzle of the rotary shaft comprises at least one type selected from the group consisting of a first nozzle for jetting the consolidating fluid in an upwardly diagonal direction with respect to the axis of the rotary shaft, a second nozzle for jetting the consolidating fluid in a downwardly diagonal direction with respect to the axis, and a third nozzle for jetting the consolidating fluid in a perpendicular direction to the axis of the rotary shaft. In particular, when the consolidating fluid is jetted from the first or second nozzle while rotating the rotary shaft during the withdrawing step, a jetting range of the consolidating fluid becomes an approximately conical shape, so that the in-situ stirring and mixing of the soil and the consolidating fluid can be performed effectively and three-dimensionally. In addition, when the second nozzle is formed in a higher position of the rotary shaft than the first nozzle such that a trace of the consolidating fluid jetted from the first nozzle crosses with a trace of the consolidating fluid jetted from the second nozzle, the in-situ stirring and mixing of the soil and the consolidating fluid can be performed more effectively.

In a further preferred embodiment of the present invention, the rotary shaft includes an expandable stirrer positioned axially downwardly of the nozzle. The expandable stirrer is capable of selectively taking an expanded form and a reduced form to vary an outside diameter of the expandable stirrer about the axis of the rotary shaft. The expandable stirrer is kept in the reduced form during the excavating step, and in the expanded form during the withdrawing step. In particular, when the rotary shaft further includes a spiral screw extending around the rotary shaft for transferring a part of an excavated soil to the outside of the hole during the excavating step, it is preferred that a radius of gyration of the expandable stirrer in the reduced form is almost equal to that of the spiral screw.

In a still further preferred embodiment of the present invention, the rotary shaft includes a bottom nozzle for jetting a fluid downwardly from around the bottom of the rotary shaft in order to facilitate the progress of the rotary shaft in the earthen foundation during the excavating step.

In another preferred embodiment of the present invention, a consolidating fluid including a reinforcing fiber is used for forming a modified ground with excellent strength in the earthen foundation. In this case, since the consolidating fluid is jetted while withdrawing the rotary shaft, the reinforcing fiber in the consolidating fluid hardly contacts with the rotary shaft, so that the rotary shaft can be smoothly withdrawn from the hole without receiving a considerable withdrawing resistance from the reinforcing fiber.

In still another preferred embodiment of the present invention, a modified ground wall is formed in the earthen foundation with an excavator having a plurality of rotary shafts in accordance with the following method. The earthen foundation is excavated with bits of the rotary shafts to from a plurality of holes without jetting the consolidating fluid from nozzles until each or the holes is excavated to reach a predetermined depth. In this time, each of the holes is not overlapped with the adjacent hole. Subsequently, the rotary shafts are withdrawn away from the holes while rotating the rotary shafts and jetting the consolidating fluid from the nozzles of the rotary shafts for enlarging a diameter of each of the holes such that each of modified ground pillars is partially overlapped with the adjacent modified ground pillar to form the modified ground wall in the earthen foundation. In addition, since a jetting range of the consolidating fluid from one of the rotary shafts is partially overlapped with a jetting range of the consolidating fluid from the adjacent rotary shaft, an effective in-situ stirring and mixing of the soil and the consolidating fluid can be performed during the withdrawing step.

It is also preferred that the rotary shafts are connected by means of a connecting member capable of rotatably supporting the rotary shafts, respectively. The rotary shafts are advanced in the earthen foundation together with the connecting member while keeping a parallel relation between the adjacent rotary shafts. The connecting member has at least one auxiliary nozzle for jetting a fluid downwardly to facilitate the progress of the connecting member into the earthen foundation.

Other features, objects and advantages of the present invention will become more apparent from the following description and the attached drawings about the preferred embodiments.

DESCRIPTION OF THE PREFERRED EMBODIMENTS

Figure 1:
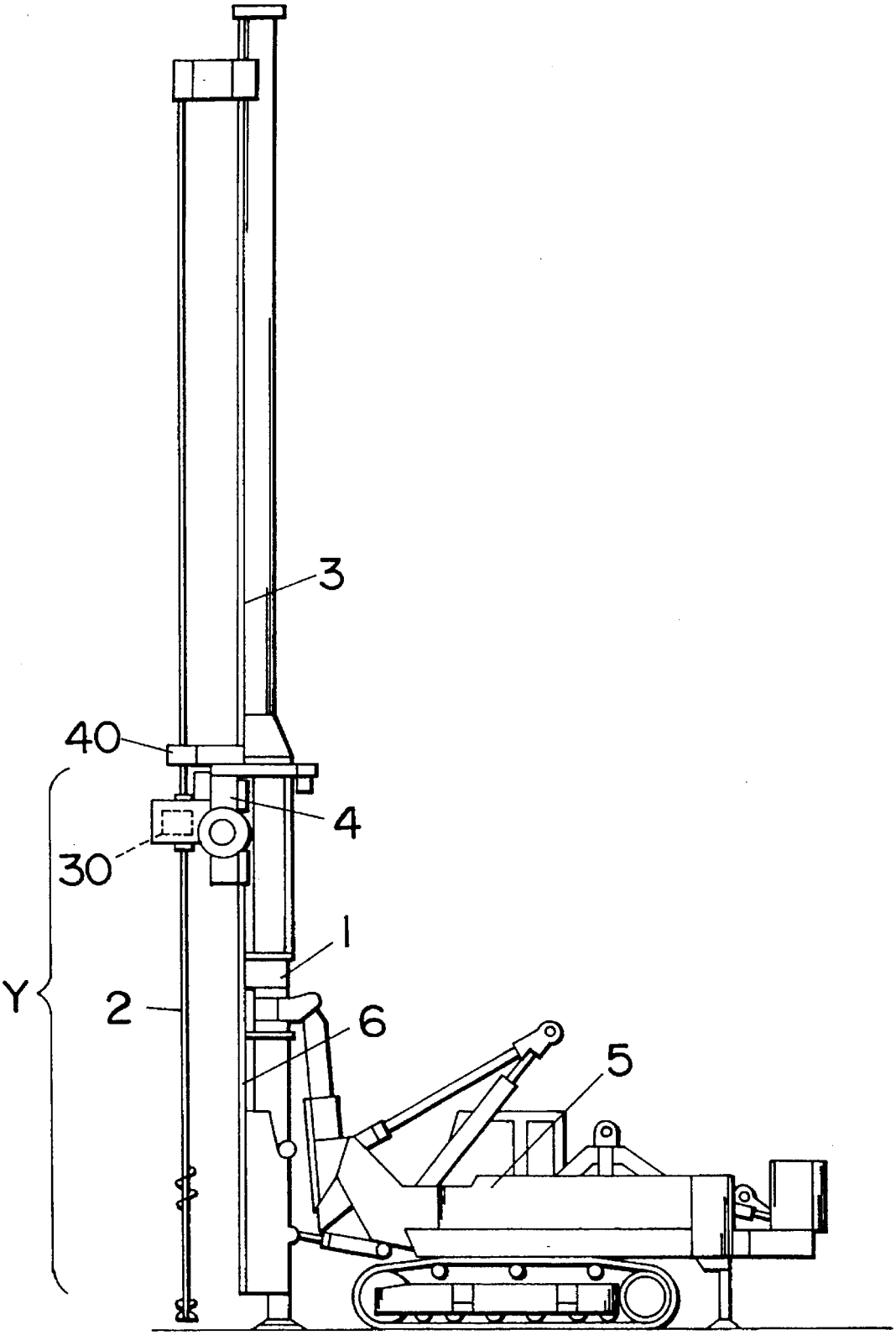
FIG. 1 is an overall side view of an excavator used in an embodiment of the present invention.

FIG. 1 shows an excavator 1 fixed on an earthen foundation. The excavator 1 has an auger shaft 2 for excavating the earthen foundation, a tower 3 vertically stood on the earthen foundation, a movable housing 4 for incorporating a driving device (not shown) for rotating the auger shaft 2 and a main chucking device 30 for rotatably chucking the auger shaft 2, and an operation unit 5 for controlling the excavator 1. The movable housing 4 is moved upwardly and downwardly by using a wire or chain along a guide rail 6 of the tower 3 for a vertical travel which is shown by the range "Y" of FIG. 1. The excavator 1 further includes an auxiliary chucking device 40 of the auger shaft 2 which is disposed in the vicinity of a top end position of the vertical travel Y.

Figure 2:
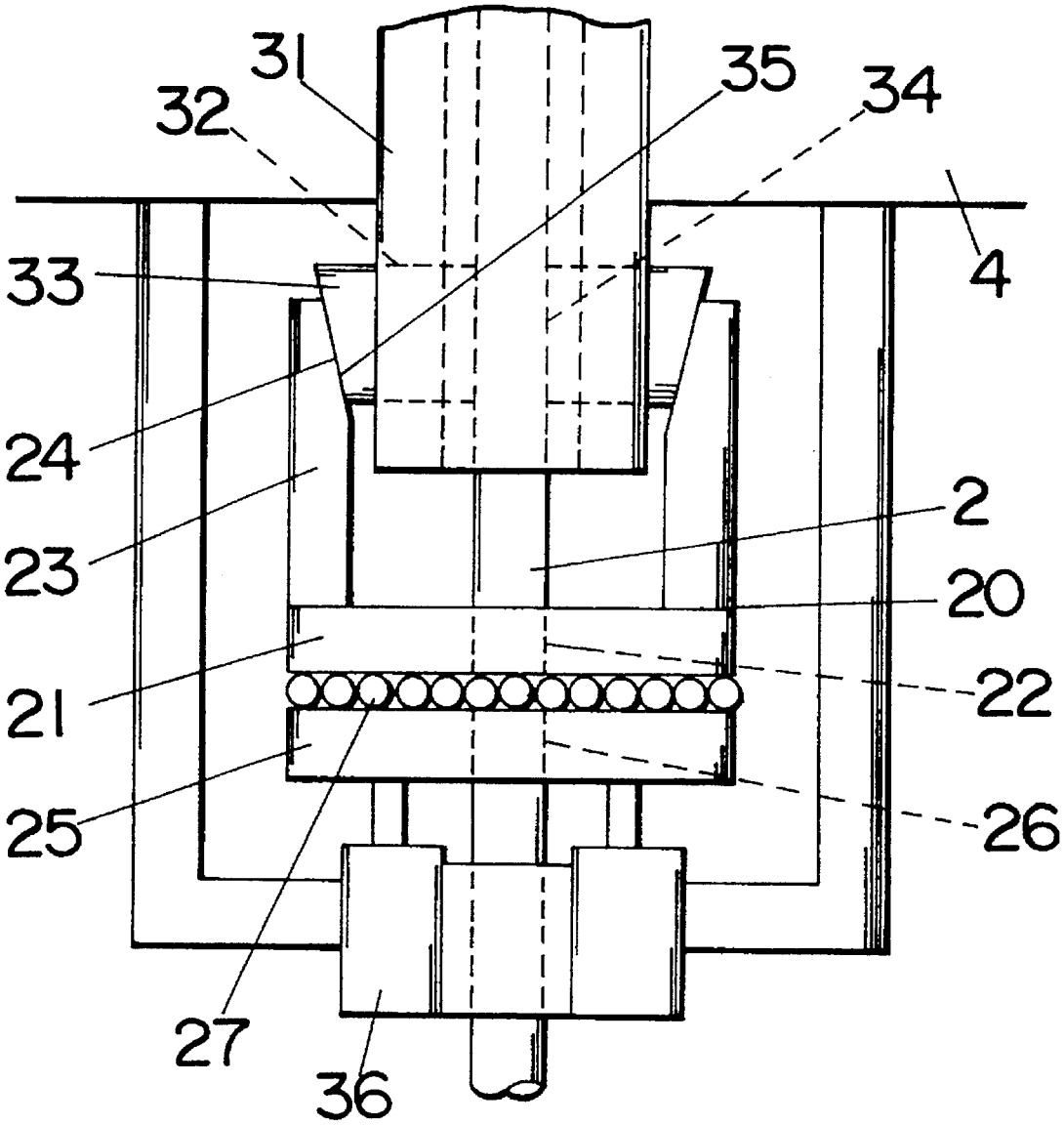
FIG. 2 is a plane view of a main chucking device of an augur shaft of the excavator.
Figure 3:
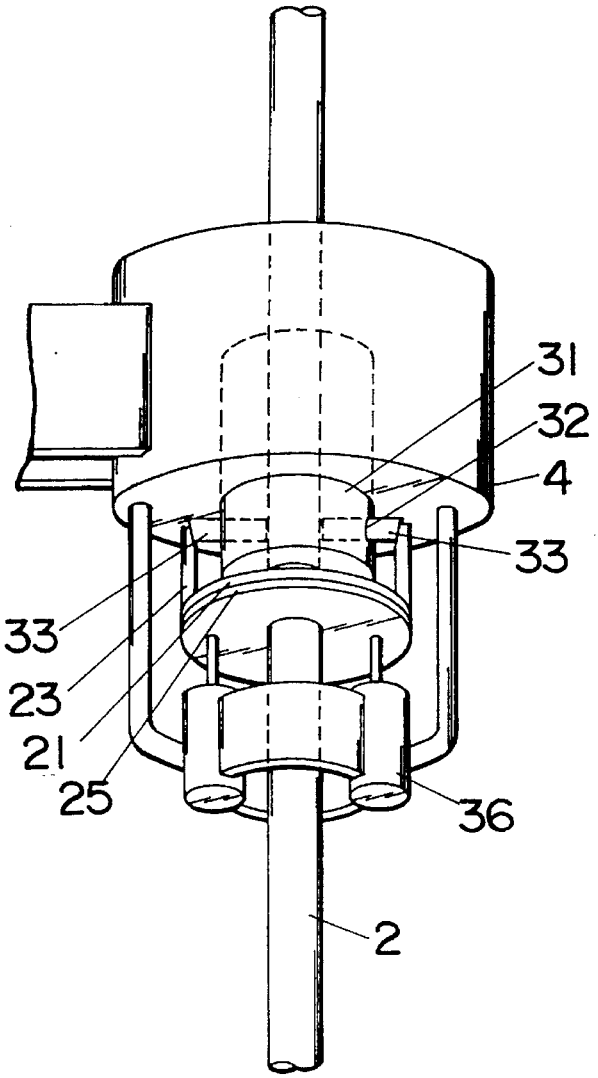
FIG. 3 is a perspective view of the main chucking device.

As shown in FIGS. 2 and 3, the auger shaft 2 passes through a rotary cylinder 31 and rotatably contacts with the inner surface of the rotary cylinder 31. The rotary cylinder 31 is rotated by the driving device. The rotary cylinder 31 has a pair of horizontal through-holes 32 extending in a diametral direction thereof. Chucking arms 33 are respectively put in the horizontal through-holes 32 to be slidably in the diametral direction of the rotary cylinder 31. The auger shaft 2 is chucked with a vertical end 34 of each of the chucking arms 33. Inclined ends 35 of the chucking arms 33 respectively project from the horizontal through-holes 32 outwardly. A coupling member 20 is formed with a bottom disc 21 having center through-hole 22 for the augur shaft 2 and a pair of vertical arms 23 extending perpendicularly on the bottom disc 21. Tapered ends 24 of the vertical arms 23 slidably contact with the inclined ends 35 of the chucking arms 33, respectively. A disc table 25 having a center through-hole 26 for the auger shaft 2 is moved upwardly or downwardly by a pair of hydraulic lifter 36 disposed radially of the auger shaft 2. A ball bearing 27 is arranged between the bottom disc 21 and the disc table 25 such that the coupling member 20 can be rotated about the auger shaft 2 on the disc table 25 through the ball bearing 27. Therefore, as the disc table 25 is moved upwardly or downwardly by the hydraulic lifter 36, the coupling member 20 is also moved upwardly or downwardly together with the ball bearing 17.

As the coupling member 20 is moved upwardly by the hydraulic lifter 36, the inclined ends 35 of the chucking arms 33 respectively slide on the tapered ends 24 of the vertical arms 23 so as to chuck the augur shaft 2 with the both vertical ends 34 of the chucking arms 33. In a chuck position, the augur shaft 2 is tightly held between the chucking arms 33. When the rotary cylinder 31 is rotated by the driving device while keeping the chuck position of the coupling member 20, the rotation of the rotary cylinder 31 is transmitted to the auger shaft 2 through the chucking arms 33. Though the rotation of the rotary cylinder 31 is also transmitted to the coupling member 20 through the chucking arm 33, the coupling member 20 can rotate together with the augur shaft 2 because it is on the ball bearing 27, as described above. Therefore, in accordance with the above explained mechanism, the augur shaft 2 can be advanced to or withdrawn from the earthen foundation by moving the movable housing 4 downwardly or upwardly while rotating the auger shaft 2.

Figure 4:
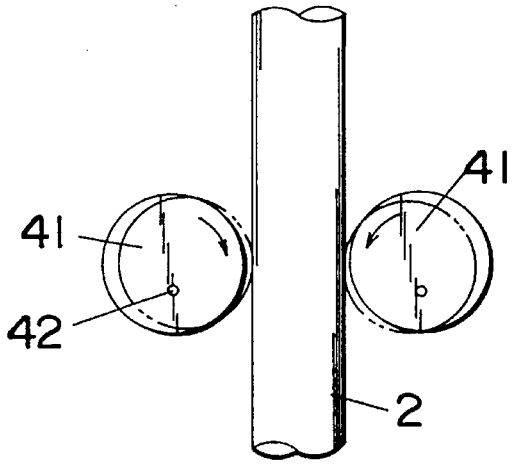
FIG. 4 explains a chucking method of an auxiliary chucking device of the augur shaft.

On the other hand, when the coupling member 20 is moved downwardly from the chuck position by the hydraulic lifter 36, the chucking of the augur shaft 2 with both vertical ends 34 is released. Therefore, in a release position of the coupling member 20, since the rotation of the rotary cylinder 31 is not transmitted to the auger shaft 2 through the chucking arms 33, it is possible to move the movable housing 4 upwardly or downwardly without varying a position of the auger shaft 2. In particular, it is preferred that the auger shaft 2 is chucked with the auxiliary chucking device 40 for stably holding the auger shaft 2 when the chucking of the auger shaft 2 with the main chucking device 30 is released. For example, the auxiliary chucking device 40 is formed with a pair of chucking members 41 each of which has an eccentric axis 42. Each of the chucking members 41 is rotated about the eccentric axis 42, as indicated by the arrows of FIG. 4, in order to hold the augur shaft 2 between the chucking members 41.

Figure 5:
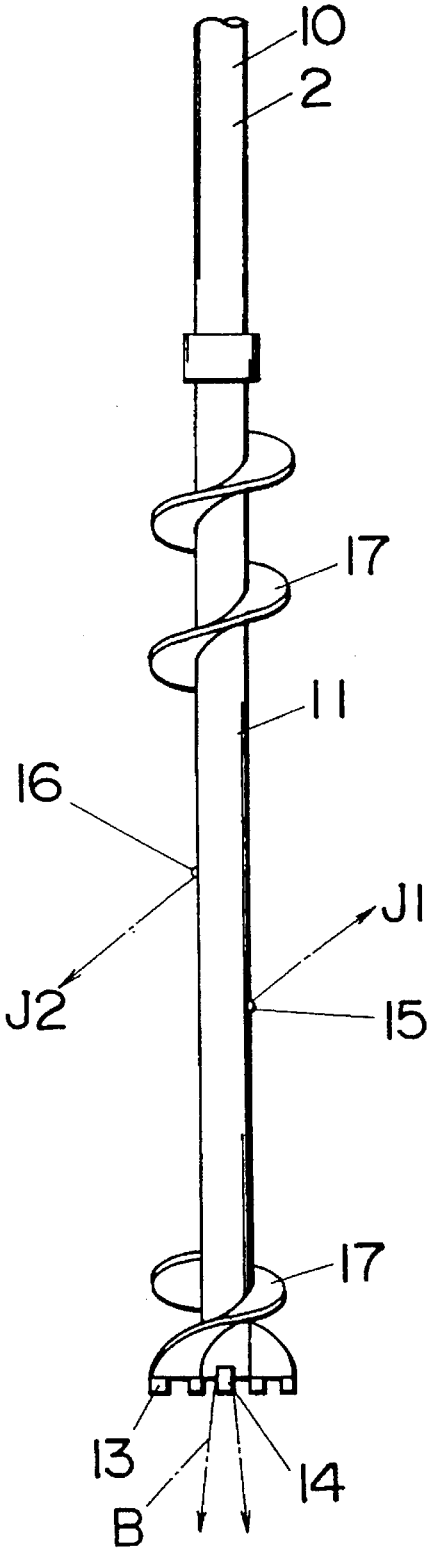
FIG. 5 is an enlarged front view of the augur shaft.
Figure 6:
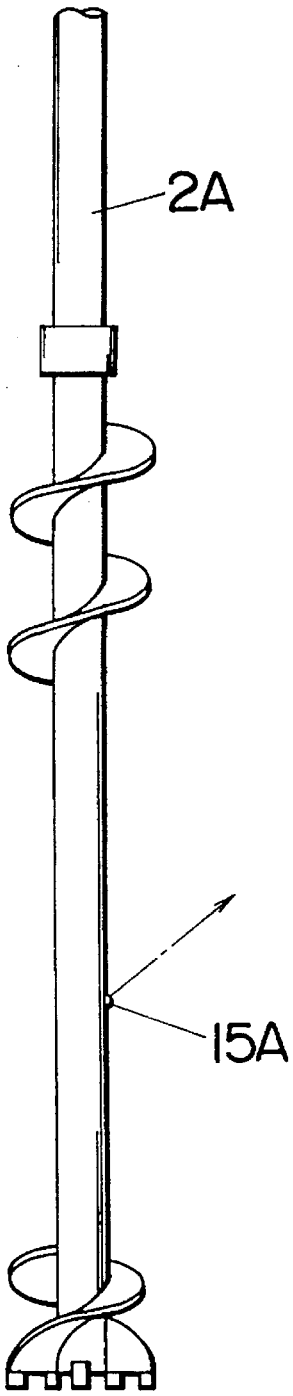
FIG. 6 is an enlarged front view of an augur shaft having only one first nozzle.
Figure 7:
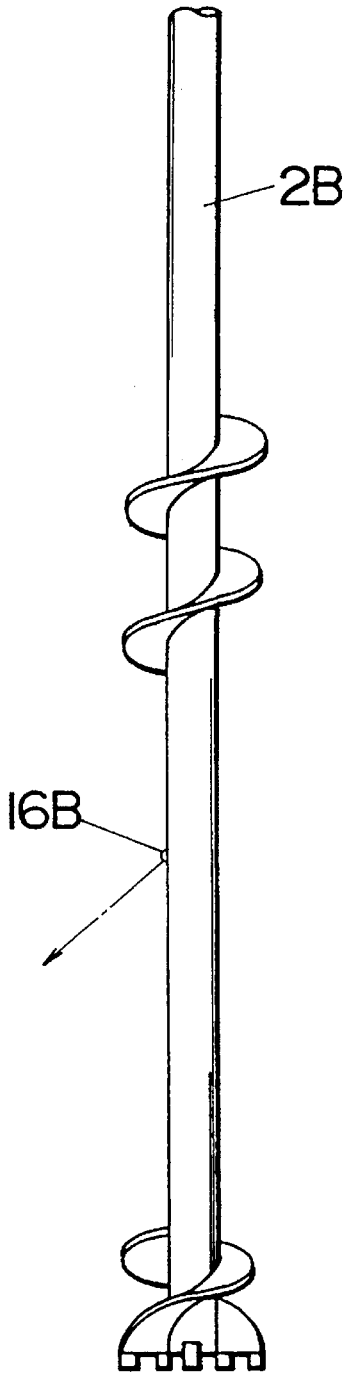
FIG. 7 is an enlarged front view of an augur shaft having only one second nozzle.
Figure 8:
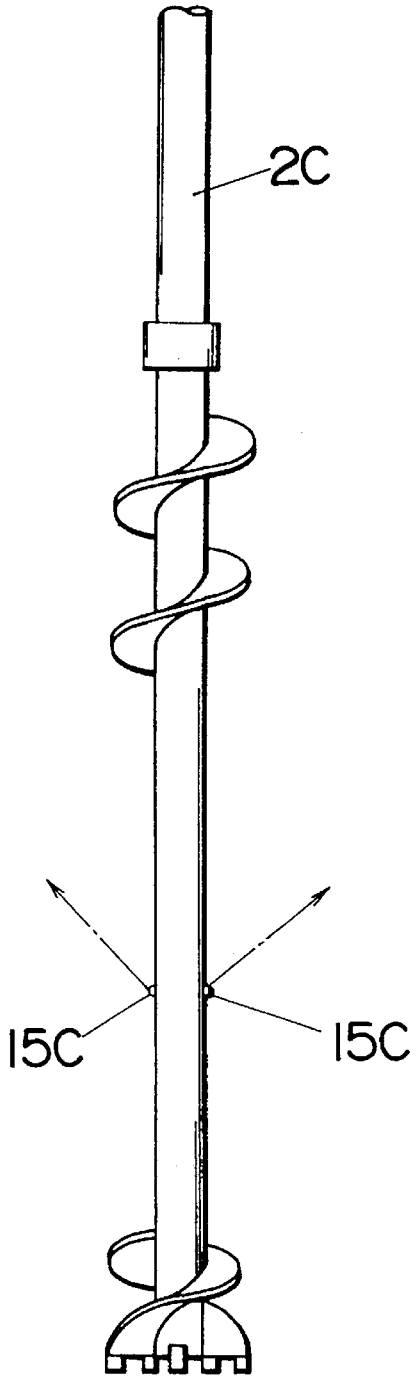
FIG. 8 is an enlarged front view of an augur shaft having a plurality of first nozzles.
Figure 9:
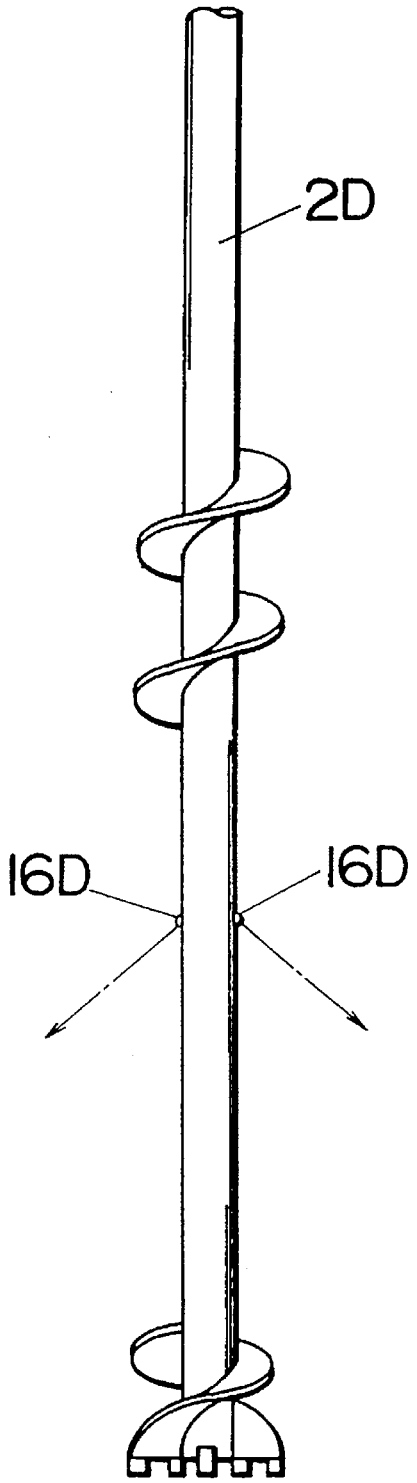
FIG. 9 is an enlarged front view or an augur shaft having a plurality of second nozzles.
Figure 10:
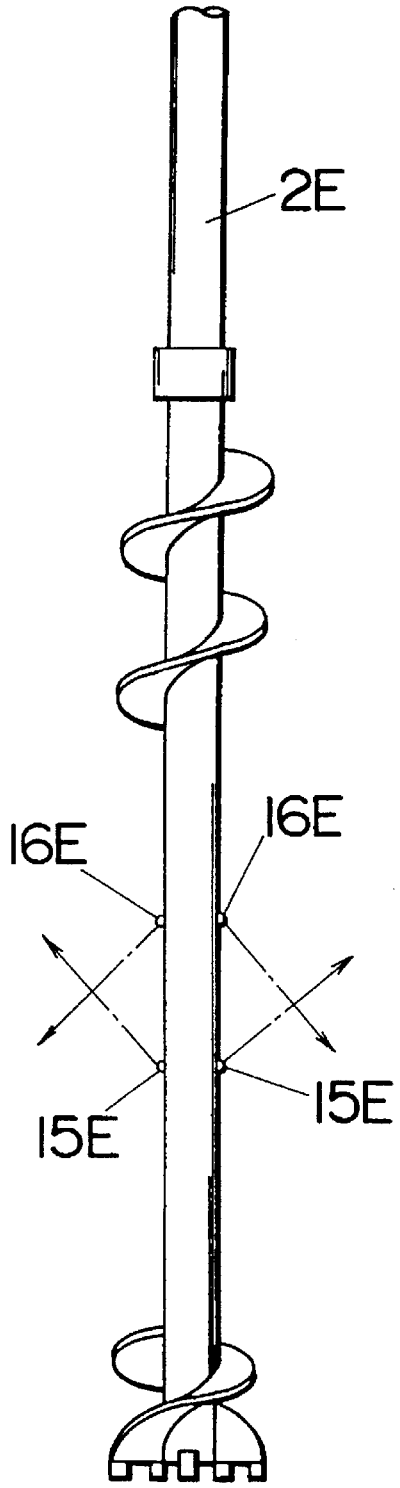
FIG. 10 is an enlarged front view of an augur shaft having a plurality of first and second nozzles.

As shown in FIG. 5, the augur shaft 2 is formed with a lower rod having excavating components, an upper rod 10 for extending the lower rod 11 to a predetermined depth in the earthen foundation, and a joint 12 connecting between the upper rod 10 and lower rod 11. The lower rod 11 includes a bit 13 on a bottom end thereof, a bottom nozzle 14 for jetting a fluid downwardly therefrom, as shown by the arrows B of FIG. 5 in order to facilitate the progress of the auger shaft 2 in the earthen foundation, a first nozzle 15 for jetting a consolidating fluid in an upwardly diagonal direction with respect to the axis of the augur shaft 2, as shown by the arrow J1 of FIG. 5, a second nozzle 16 for jetting the consolidating fluid in a downwardly diagonal direction with respect to the axis, as shown by the arrow J2 of FIG. 5, and a spiral screw 17 extending around the lower rod 11 for transferring a part of an excavated soil to the outside of an excavated hole. It is possible to use, in place of the first nozzle, a third nozzle (not shown) for jetting the consolidating fluid in a perpendicular direction to the axis of the augur shaft. The consolidating fluid is comprised of cement milk, a fluid mixture the main ingredient of which is cement milk or a synthetic resin solution, etc. On the other hand, the fluid jetted from the bottom nozzle 14 is composed of a diluted cement milk or a mixture solution of cement milk and bentonite, etc. The second nozzle 16 is disposed upwardly of the first nozzle 15 such that a trace of the consolidating fluid jetted from the first nozzle 15 crosses with a trace of the consolidating fluid jetted from the second nozzle 16. Of course, in the present invention, it is possible to use any one of the following augur shafts in place of the above augur shaft 2 in response to a character of an earthen foundation. That is, the augur shafts includes an augur shaft 2A of FIG. 6 having only one first nozzle 15A, an augur shaft 2B of FIG. 7 having only one second nozzle 16B, an augur shaft 2C of FIG. 8 having a plurality of first nozzles 15C, an augur shaft 2D of FIG. 9 having a plurality of second nozzles 16D, and an augur 2E of FIG. 10 having a plurality of first nozzles 15E and second nozzles 16E. Each of arrows drawn in FIGS. 6 to 10 designates a jetting direction of the consolidating fluid jetted from first and/or second nozzles.

Figures 11A, 11B, 11C, 11D, 11E:
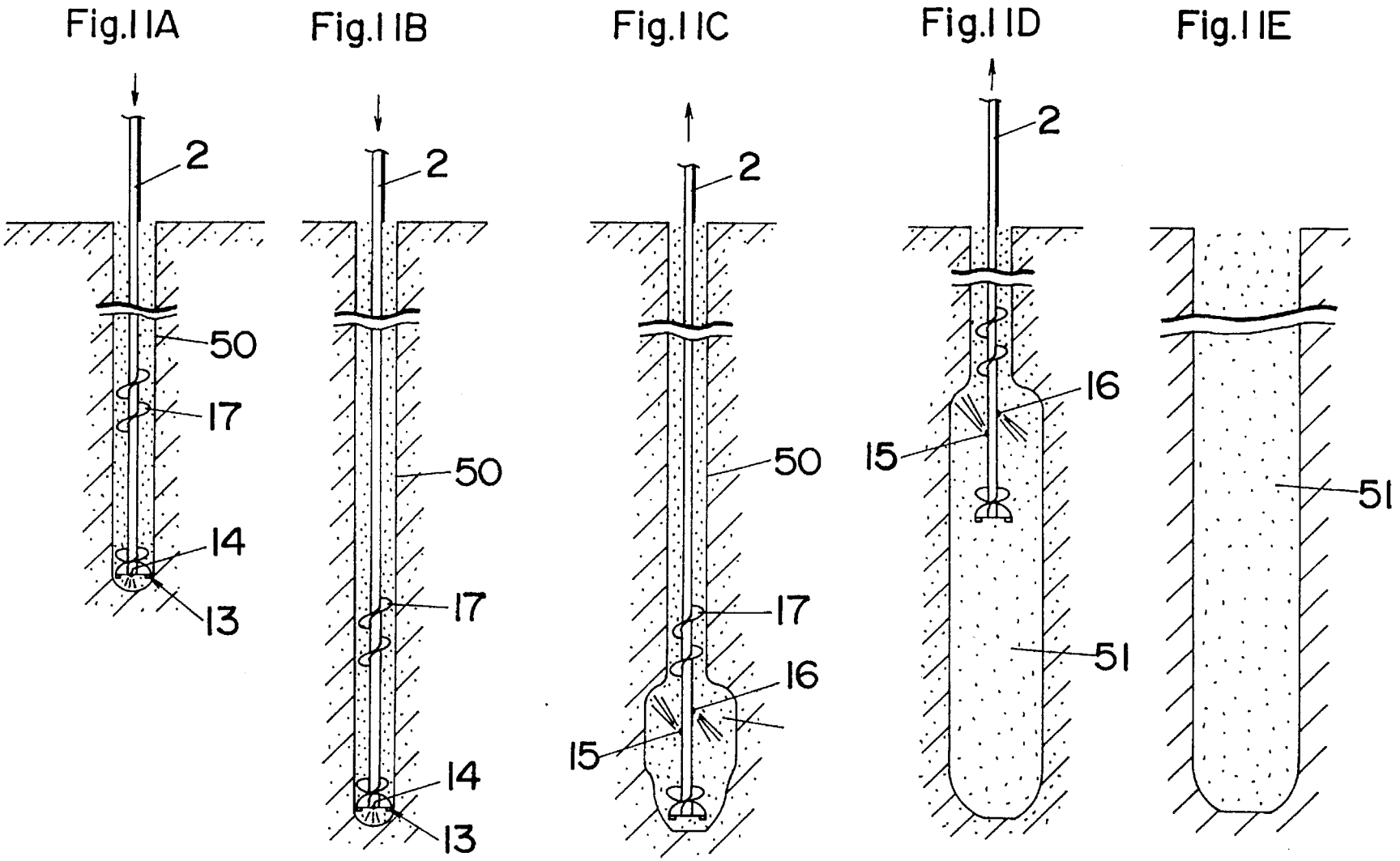
FIGS. 11A to 11E show a process of forming a modified ground pillar in an earthen foundation according to the present invention.

By using the excavator 1 with the auger shaft 2, a modified ground pillar 51 is formed in an earthen foundation in accordance with the following method of the present invention. That is, the present method comprises an excavating step, as shown in FIGS. 11A and 11B, and an withdrawing step of the auger shaft 2, as shown in FIGS. 11C to 11E. In the excavating step, the earthen foundation is excavated with the bit 13 to form therein a hole 50 by rotating the auger shaft 2 while jetting the fluid from the bottom nozzle 14 and without jetting the consolidating fluid from the first and second nozzles (15 and 16) until the hole 50 reaches a predetermined depth, as shown in FIG. 11B. In the withdrawing step, the auger shaft 2 is withdrawn away from the bottom of the hole 50 without jetting the fluid from the bottom nozzle 14 and while rotating the auger shaft 2 and jetting the consolidating fluid from the first and second nozzles (15 and 16) against soil surrounding the hole 50 to break the same for enlarging the diameter of the hole 50 in such a manner as to perform an in-situ stirring and mixing of the consolidating fluid and the soil, so that the modified ground pillar 51 having a larger diameter than the hole 50 is formed in the earthen foundation, as shown in FIG. 11E. The diameter of the modified ground pillar 51 can be varied by controlling an injection pressure of the consolidating fluid in response to a character of an earthen foundation of a planned site of the modified ground pillar 51. The spiral screw 17 is useful to keep the excavated soil softly in the hole 50 during the excavating step, and to sufficiently perform the in-situ stirring and mixing during the withdrawing step. That is, since a part of the excavated soil is exhausted to the outside of the hole 50 during the excavating step, it is possible to prevent an overflow of the fluid jetted from the bottom nozzle 14 from the hole 50.

Figure 12:
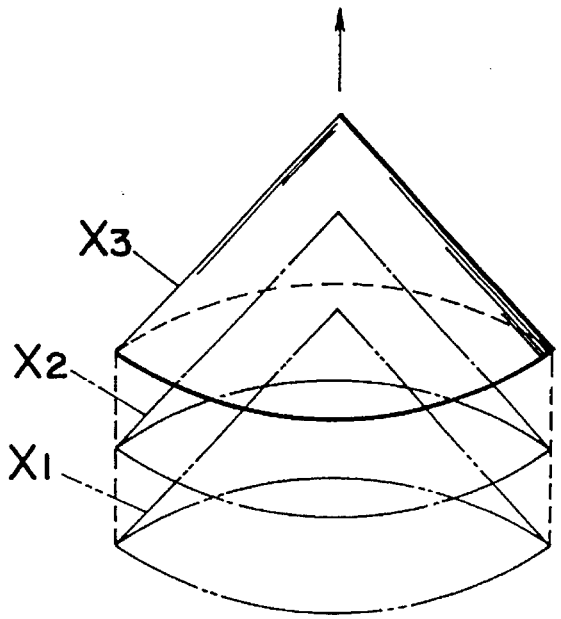
FIG. 12 is an explanatory diagram showing a stirring and mixing range for when a consolidating fluid is jetted from a second nozzle of an augur shaft while rotating the augur shaft.
Figure 13:
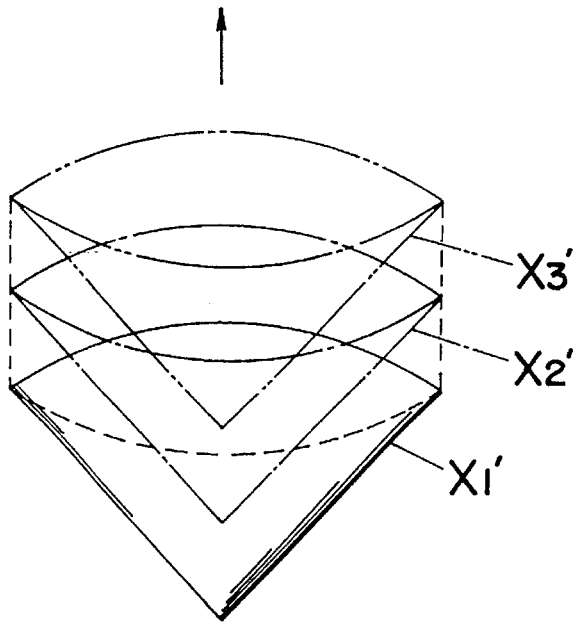
FIG. 13 is an explanatory diagram showing a stirring and mixing range for when a consolidating fluid is jetted from a first nozzle of an augur shaft while rotating the augur shaft.

By the way, when the auger shaft 2 is rotated while jetting the consolidating fluid diagonally downward from the second nozzle 16, the trace of the consolidating fluid is in an approximately conical shape and the stirring and mixing range also becomes an approximately conical shape, as shown in FIG. 12. As a result, in comparison to a circularly shaped stirring and mixing range for when an auger shaft is rotated while jetting the consolidating fluid horizontally, a three-dimensional stirring and mixing range is obtained. Therefore, it is possible to perform an effective stirring and mixing of the consolidating fluid and the excavated soil. When the auger shaft 2 is withdrawn away from the hole 50 while rotating the auger shaft 2 and jetting the consolidating fluid from the second nozzle 16, a three-dimensional (approximately conically shaped) stirring and mixing range X1 shifts upward X2, X3 . . . , as shown in FIG. 12. Similarly, when the auger shaft 2 is withdrawn away from the hole 50 while rotating the auger shaft 2 and jetting the consolidating fluid from the first nozzle 15, an approximately upside-down conically shaped stirring and mixing range X'1 shifts upward X'2, X'3 . . . , as shown in FIG. 13. In particular, when the second nozzle 16 is disposed upwardly of the first nozzle 15 such that the trace of the consolidating fluid jetted from the first nozzle 15 crosses with the trace of the consolidating fluid jetted from the second nozzle 16, the conical shaped stirring and mixing range formed by the consolidating fluid jetted from the second nozzle 16 is three-dimensionally overlapped with the upside-down conical shaped stirring and mixing range formed by the consolidating fluid jetted from the first nozzle 15.

Figure 14:
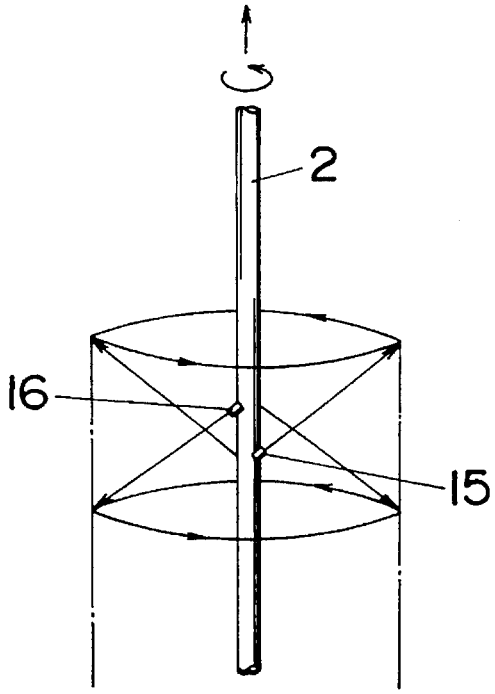
FIG. 14 is an explanatory diagram showing a stirring and mixing range for when a consolidating fluid is jetted from first and second nozzles of an augur shaft while rotating the augur shaft.
Figure 24:
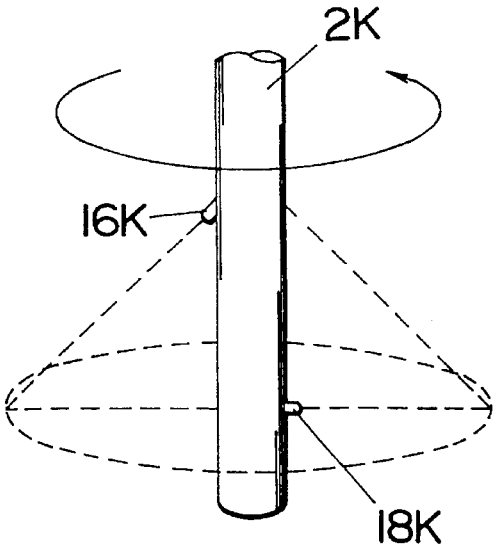
FIG. 24 is an explanatory diagram showing a stirring and mixing range for when a consolidating fluid is jetted from second and third nozzles of an augur shaft while rotating the augur shaft.

Therefore, it is possible to perform the in-situ stirring and mixing more efficiently during the withdrawing step. In this case, it is also preferred that the second nozzle 16 is spaced away from the first nozzle 15 radially of the augur shaft 2 because of preventing a direct collision of the consolidating fluid jetted from the first nozzle 15 with the consolidating fluid jetted from the second nozzle 16, as shown in FIG. 14. In addition, when an augur shaft has second and third nozzles (16K and 18K), as shown in FIG. 24, it is preferred that the second nozzle 16K is spaced away from a third nozzle 18K radially of an augur shaft 2K and disposed upwardly of the third nozzle 18K such that a trace of the consolidating fluid jetted from the second nozzle 16K crosses with a trace of the consolidating fluid jetted from the third nozzle 18K. In FIG. 24, the dotted lines designate the traces of the consolidating fluid.

Figure 15:
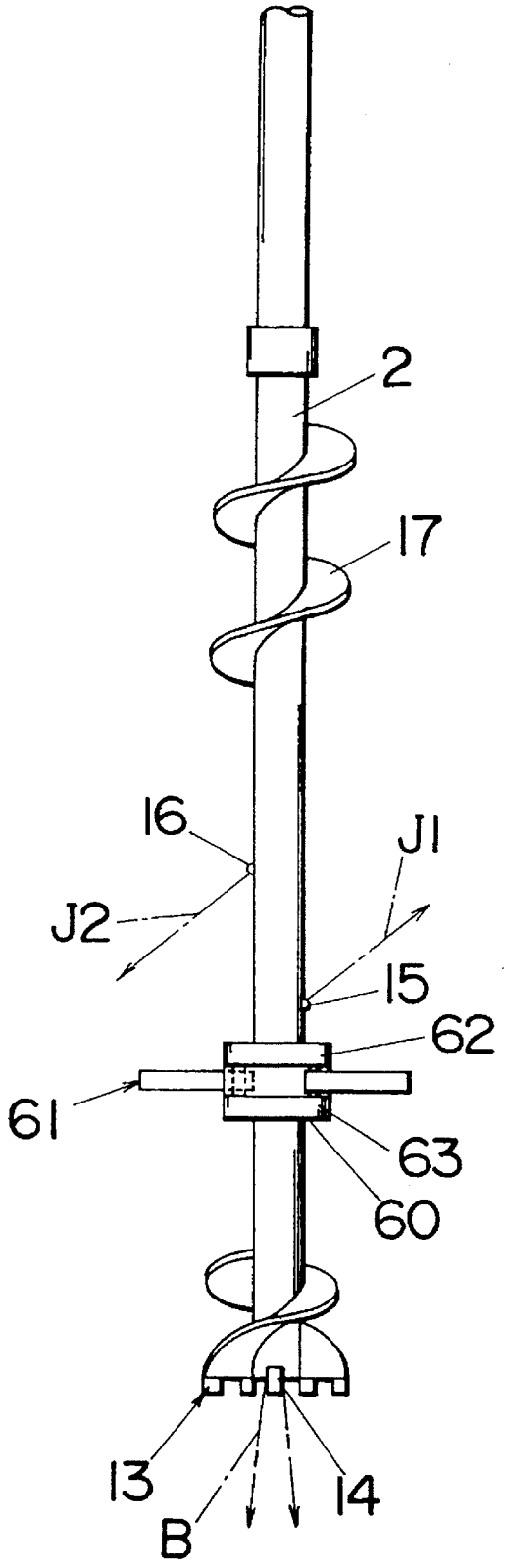
FIG. 15 is an enlarged front view of an augur shaft having a folding stirrer.
Figures 16A, 16B, 16C, 16D:
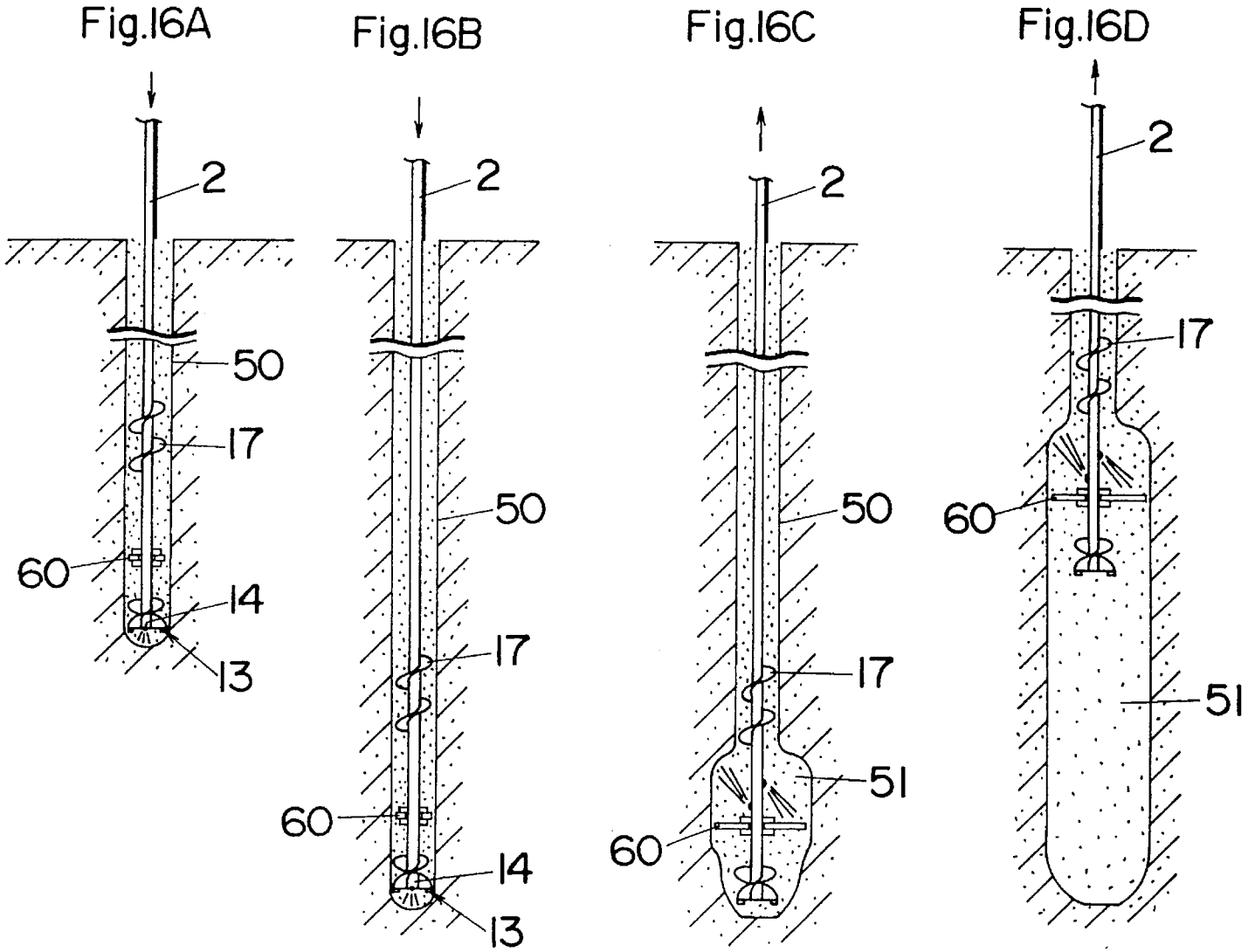
FIGS. 16A to 16D show a process of forming a modified ground pillar in the earthen foundation by using the augur shaft of FIG. 15 according to the present invention.
Figure 17:
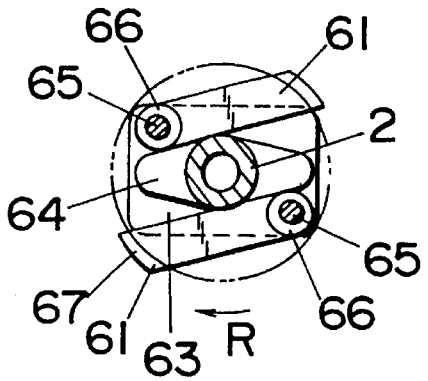
FIG. 17 is a transversely cross-sectional view of the folding stirrer in a folded form.
Figure 18:
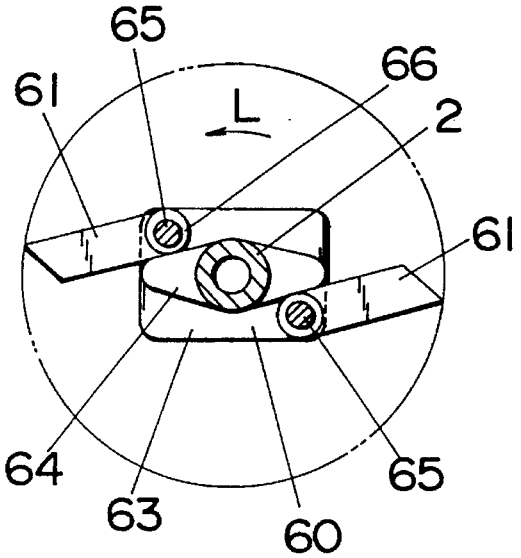
FIG. 18 is a transversely cross-sectional view of the folding stirrer in an expanded form.

For forming the modified ground pillar 51 more efficiently in the earthen foundation, it is preferred that the augur shaft 2 further includes a folding stirrer 60 which is positioned axially downwardly of the first nozzle 15, as shown in FIG. 15. The folding stirrer 60 is capable of selectively taking an expanded form and a folded form to vary an outside diameter thereof about the axis of the auger shaft 2. Therefore, in the present method, the folding stirrer 60 is kept in the folded form during the excavating step, as shown in FIGS. 16A and 16B, and in the expanded form to facilitate the stirring and mixing of the excavated soil and the consolidating fluid during the withdrawing step, as shown in FIGS. 16C and 16D. As shown in FIGS. 15, 17 and 18, the folding stirrer 60 is formed with a pair of stirring wings 61, top and bottom flanges (62 and 63) each of which is in a substantially rectangular shape, and a barrel portion 64 having a shape like a rhombic prism which is disposed between the top and bottom flanges (62 and 63). A pair of pins 65 extends from the opposed corners of the bottom flange 62 to the corresponding corners of the top flange 63. Pivot ends 66 of the stirring wings 61 are respectively engaged with the pins 65 such that each of the stirring wings 61 pivots about the pin 65 to make the expanded form or folded form of the folding stirrer 60. A cutting head 67 of each of the stirring wings 61 is useful for efficiently enlarging the diameter of the hole 50 during the withdrawing step. When the folding stirrer 60 in the folded form is rotated clockwise about the axis of the augur shaft 2, as indicated by the arrow R of FIG. 17, the stirring wings 61 respectively pivot counterclockwise about the pins 65 to make and keep the expanded form of the folding stirrer 60, as shown in FIG. 18. On the contrary, when the folding stirrer 60 in the expanded form is rotated counterclockwise about the axis of the augur shaft 2, as indicated by the arrow L of FIG. 18, the stirring wings 60 respectively pivot clockwise about the pins 65 to back in the folded form thereof, as shown in FIG. 17.

Figure 19:
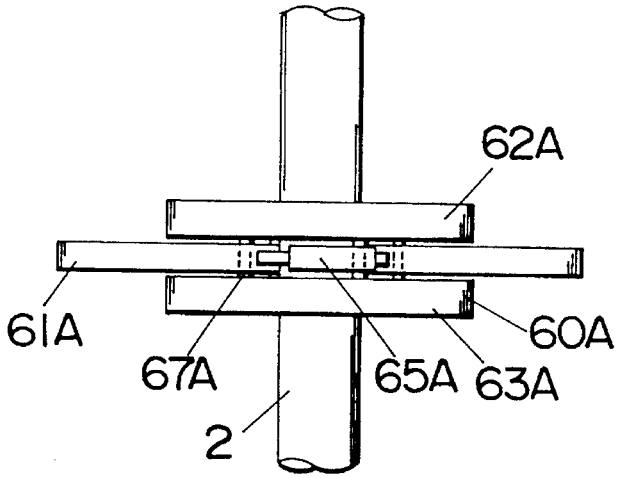
FIG. 19 is a longitudinally plane view of another folding stirrer in an expanded form.
Figure 20:
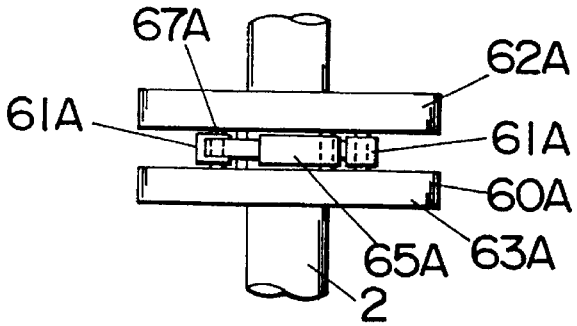
FIG. 20 is a longitudinally plane view of the folding stirrer of FIG. 19 in a folded form.
Figure 21:
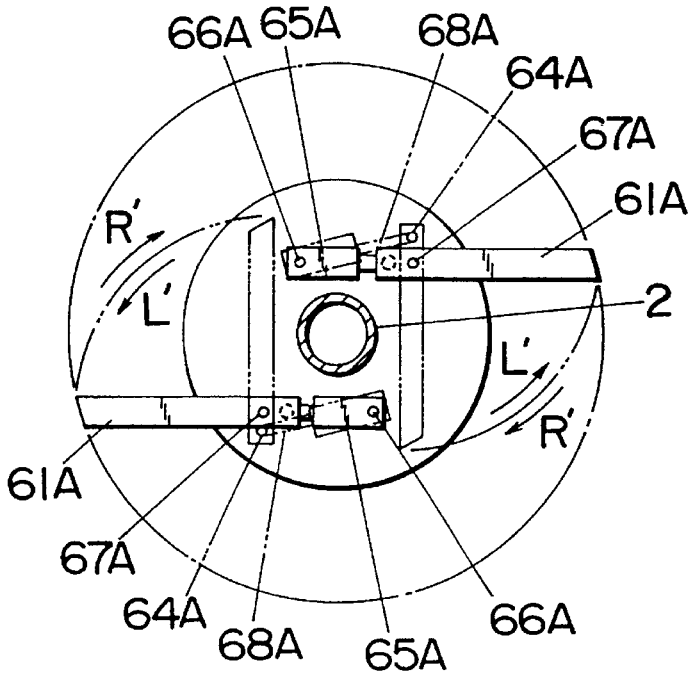
FIG. 21 explains how to expand the folding stirrer of FIG. 19.

It is further preferred that the augur shaft 2 has another folding stirrer 60A in place of the above folding stirrer 60, as shown in FIGS. 19, 20 and 21. The folding stirrer 60A comprises a pair of folding units, and top and bottom discs (62A and 63A) each of which has a center through-hole for the augur shaft 2. Each of the folding unit includes a stirring rod 61A having a joint portion 64A at one end thereof, an oil hydraulic device 65A, a first pin 66A for allowing the oil hydraulic device 65A to pivot about the first pin 66A, and a second pin 67A for allowing the stirring rod 61A to pivot about the second pin 67A. The first and second pins (66A and 67A) of one folding unit are respectively positioned in a central-symmetrical relation about the axis of the augur shaft 2 with the first and second pins (66A and 67A) of the other folding unit. An extendable cylinder 68A of the oil hydraulic device 65A is jointed with the joint portion 64A of the stirring rod 61A such that when the extendable cylinder 68A of the oil hydraulic device 65A is in a reduced position, the stirring rod 61A pivots counterclockwise about the second pin 67A, as indicated by the arrow L' of FIG. 21, to obtain an expanded form of the folding stirrer 60A of FIG. 19, and on the contrary, when the extendable cylinder 68A is in an extended position, the stirring rod 61A pivots clockwise about the second pin 67A, as indicated by the arrow R' of FIG. 21, to obtain a folded form of the folding stirrer 60A of FIG. 20. In FIG. 21, a dotted line designates the folded form of the folding stirrer 60A, and a solid line designates the expanded form of the folding stirrer 60A.

Figure 22:
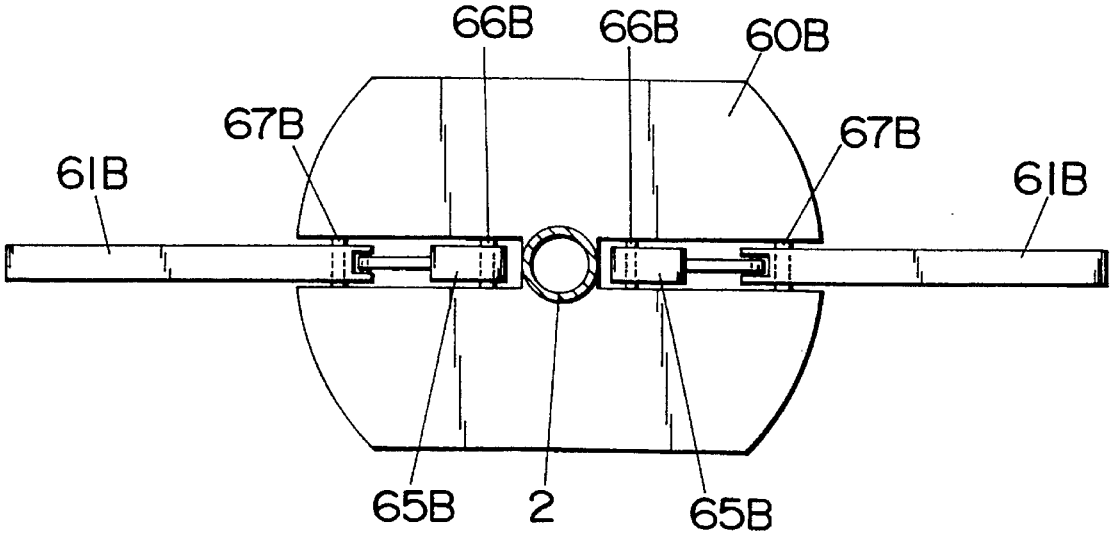
FIG. 22 is a transversely plane view of still another folding stirrer in an expanded form thereof.
Figure 23:
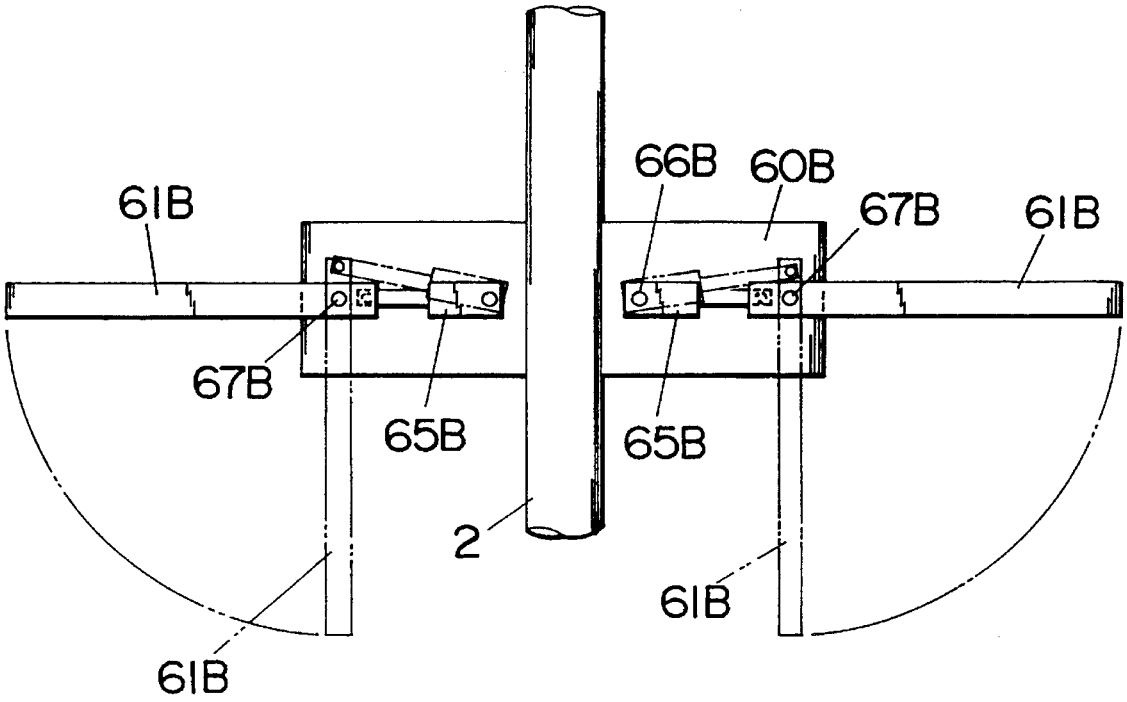
FIG. 23 explains how to expand the folding stirrer of FIG. 22.

It is still further preferred that the augur shaft 2 has still another folding stirrer 60B in place of the above folding stirrer 60, as shown in FIGS. 22 and 23. Stirring rods 61B of the folding stirrer 60B are respectively expanded or folded in accordance with substantially same manner as the folding stirrer 60A except that each of the tracks of the stirring rods 61B is on a vertical plane parallel with the axis of the augur shaft 2 in place of the tracks of the stirring rods 61A of the folding stirrer 60A which is on a horizontal plane perpendicular to the axis of the augur shaft 2. In FIG. 23, a dotted line designates a folded form of the folding stirrer 60B, and a solid line designates an expanded form of the folding stirrer 60B.

Of course, for efficiently performing the present method in response to a character of an earthen foundation as a planned site of a modified ground pillar, it is possible to use an augur shaft having optimum components selected from at least one first nozzle for jetting a consolidating fluid in an upwardly diagonal direction with respect to the axis of the augur shaft, at least one second nozzle for jetting the consolidating fluid in a downwardly diagonal direction with respect to the axis of the augur shaft, at least one third nozzle for jetting the consolidating fluid in a perpendicular direction to the axis of the augur shaft, a bottom nozzle for jetting a fluid downwardly therefrom, a spiral screw extending around the augur shaft, and an expandable stirrer.

Figure 25:
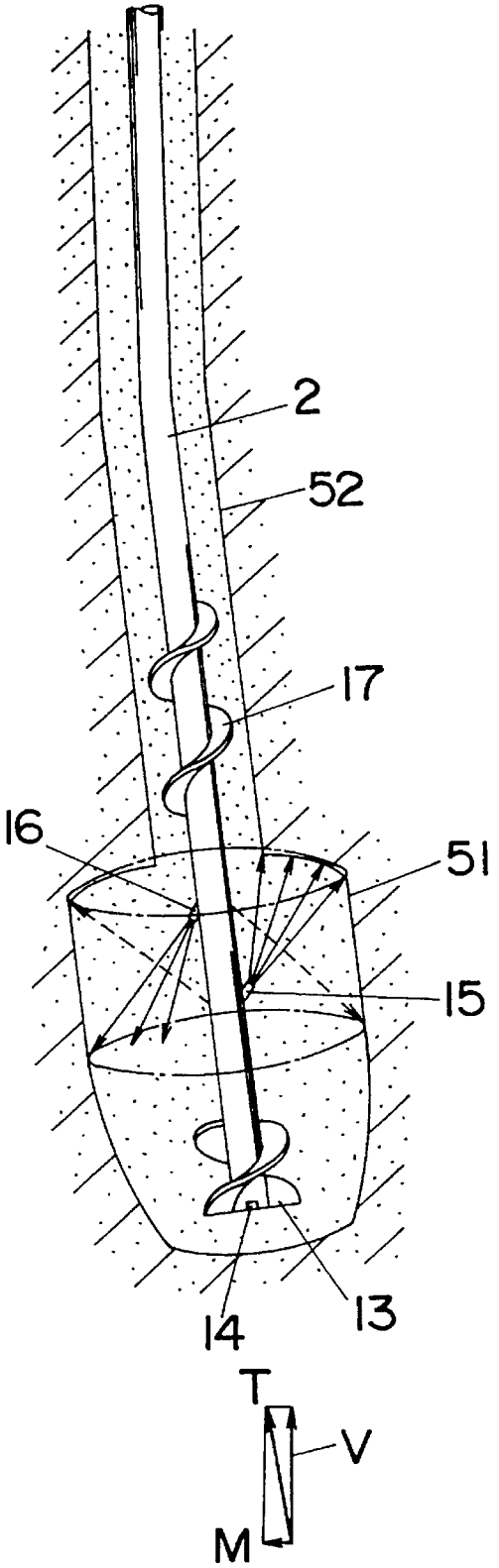
FIG. 25 explains a force working to an augur shaft when the augur shaft is withdrawn from an inclined hole.

By the way, the augur shaft 2 may be accidentally advanced into an earthen foundation along an inclined direction against the earthen foundation due to a contacting pressure between the bit 13 and the earthen foundation during the excavating step, so that there is a problem of forming an inclined hole 52 in the earthen foundation, as shown in FIG. 25. However, in the present method, when the augur shaft 2 is withdrawn away from the inclined hole 52 by a withdrawing force, as indicated by the arrow "T" of FIG. 25, while rotating the augur shaft 2 and jetting the consolidating fluid, a recovery force of the augur shaft 2 effectively works, as indicated by the arrow "M" of FIG. 25, to allow the auger shaft 2 in the inclined hole 52 to be in perpendicular to the earthen foundation. That is, since the contacting pressure is released from the bit 13 during the withdrawing step, and the jetting of the consolidating fluid softens soil surrounding the inclined hole 52, the augur shaft 2 in the inclined hole 52 can recover its own vertical accuracy immediately after starting the withdrawing step. Therefore, even if an inclined hole is formed in an earthen foundation during the excavating step, a modified ground pillar having an improved vertical accuracy thereof can be formed in the earthen foundation by withdrawing the augur shaft from the inclined hole in accordance with the withdrawing step of the present invention. The arrow "V" of FIG. 25 designates a vertical component of the withdrawing force "T".

Figure 26:
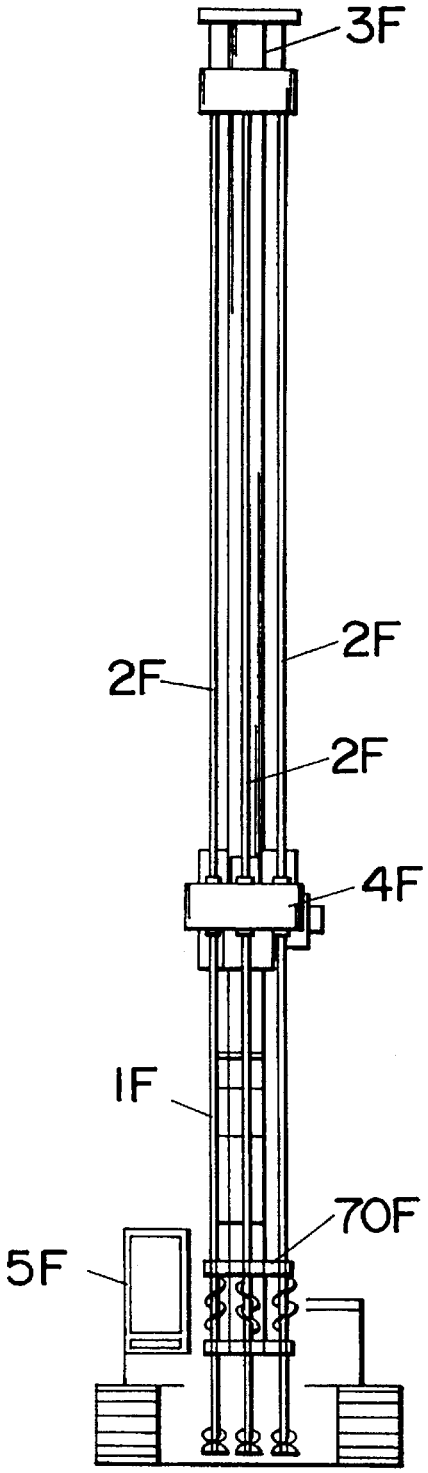
FIG. 26 is a front view of an excavator having a plurality of augur shafts used in an embodiment of the present invention.
Figure 27:
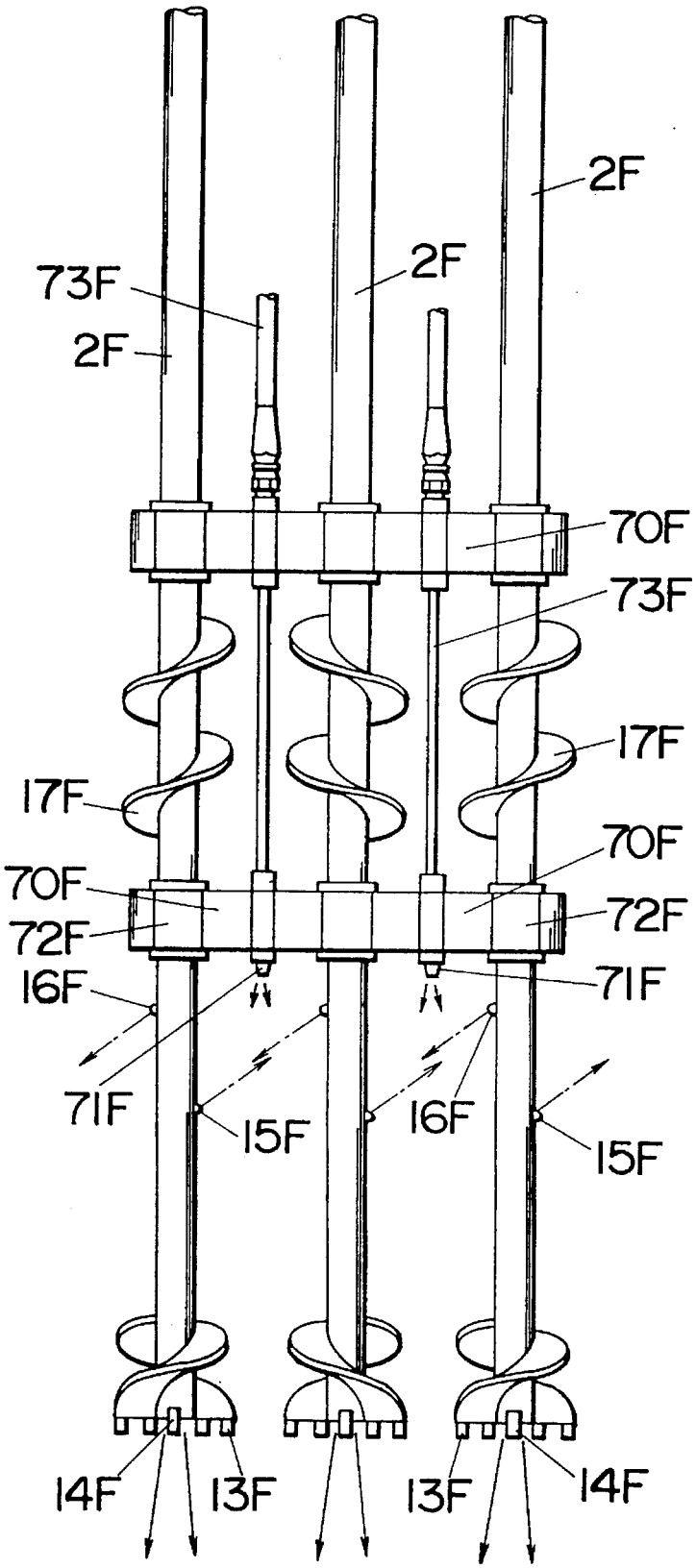
FIG. 27 is an enlarged front view of the augur shafts of FIG. 26.

In addition, it is preferred to use an excavator 1F capable of excavating an earthen foundation with a plurality of augur shafts 2F, for example, as shown in FIGS. 26 and 27. Each of the augur shafts 2F is advanced to or withdrawn from the earthen foundation according to the substantially same manner as the above explained method with the use of the excavator 1 having the single augur shaft 2 except for the following features. A distance between the adjacent augur shafts 2F is determined such that a hole excavated by one of the augur shafts is not overlapped with a hole excavated by the adjacent augur shaft, as indicated by the interval "P" of FIG. 28B. The augur shafts 2F are connected with a tie-beam member 70F which is advanced into the earthen foundation together with the augur shafts 2F while stably maintaining the distance between the adjacent augur shafts. Of course, each of the augur shafts 2F is rotatably supported by a bearing portion 72F of the tie-beam member 70F. The tie-beam member 70F further includes a plurality of auxiliary nozzles 71F for jetting a fluid downwardly to facilitate the progress of the tie-beam member 70F into the earthen foundation. Numeral 73F designates a hose tube for supplying the fluid to the auxiliary nozzle 71F. Arrows drawn in FIG. 27 designate jetting directions of consolidating fluid and the fluid.

Figures 28A, 28B, 28C, 28D, 28E:
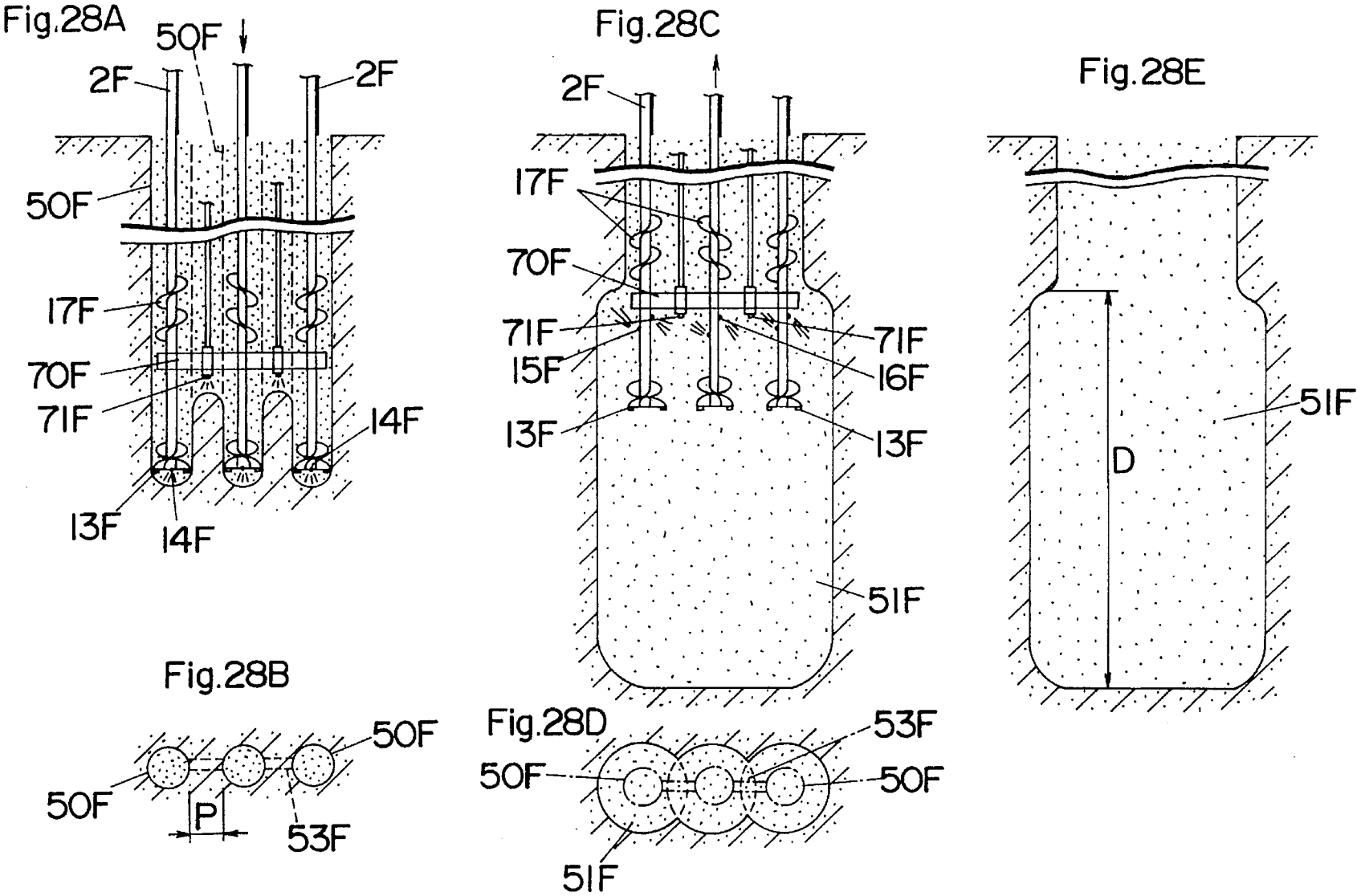
FIGS. 28A to 28E show a process of forming a modified ground wall in the earthen foundation with the augur shafts of FIG. 27 according to the present invention.

By using the excavator 1F, a modified ground wall 51F is formed in an earthen foundation in accordance with a method of the present invention. That is, the method comprises an excavating step, as shown in FIGS. 28A and 28B, and an withdrawing step of the auger shafts 2F, as shown in FIGS. 28C to 28E. In the excavating step, the earthen foundation is excavated with bits 13F of the augur shafts 2F to form therein holes 50F by rotating the auger shafts 2F while jetting a fluid from bottom nozzles 14F of the augur shafts 2F and the auxiliary nozzles 71F of tie-beam member 70F and without jetting a consolidating fluid from first and second nozzles (15F and 16F) of the augur shafts 2F until the holes 50F reach a predetermined depth. Each of the holes 50F is not overlapped with the adjacent hole and is connected with the adjacent hole by a rectangular hole 53F which is excavated by the fluid jetted from the auxiliary nozzle 71F during the excavating step, as shown in FIG. 28B. Subsequently, in the withdrawing step, the auger shafts 2F are withdrawn away from the bottom of the holes 50F without jetting the fluid from the bottom nozzles 14F and the auxiliary nozzles 71F and while rotating the auger shafts 2F and jetting the consolidating fluid from first and second nozzles (15F and 16F) against soil surrounding the holes 50F for enlarging the diameter of the holes such that each of modified ground pillars formed by the augur shafts 2F is overlapped with the adjacent ground pillar in order to form the modified ground wall 51F, as shown in FIG. 28C and 28D. In this embodiment, as shown in FIG. 28E, when the augur shafts 2F are withdrawn for a distance "D" from the bottom of the holes, the jetting of the consolidating fluid is stopped to prevent upheavals of the earthen foundation around the holes by the jetting of the consolidating fluid from the first nozzles 15F. Of course, it is possible to withdraw the augur shafts 2F while jetting the consolidating fluid from the bottom of the holes to the surface of the earthen foundation. However, in this case, it is further preferred to use augur shafts each of which does not have a first nozzle for preventing the upheavals of the earthen foundation and for safely performing the present method.

Figure 29:
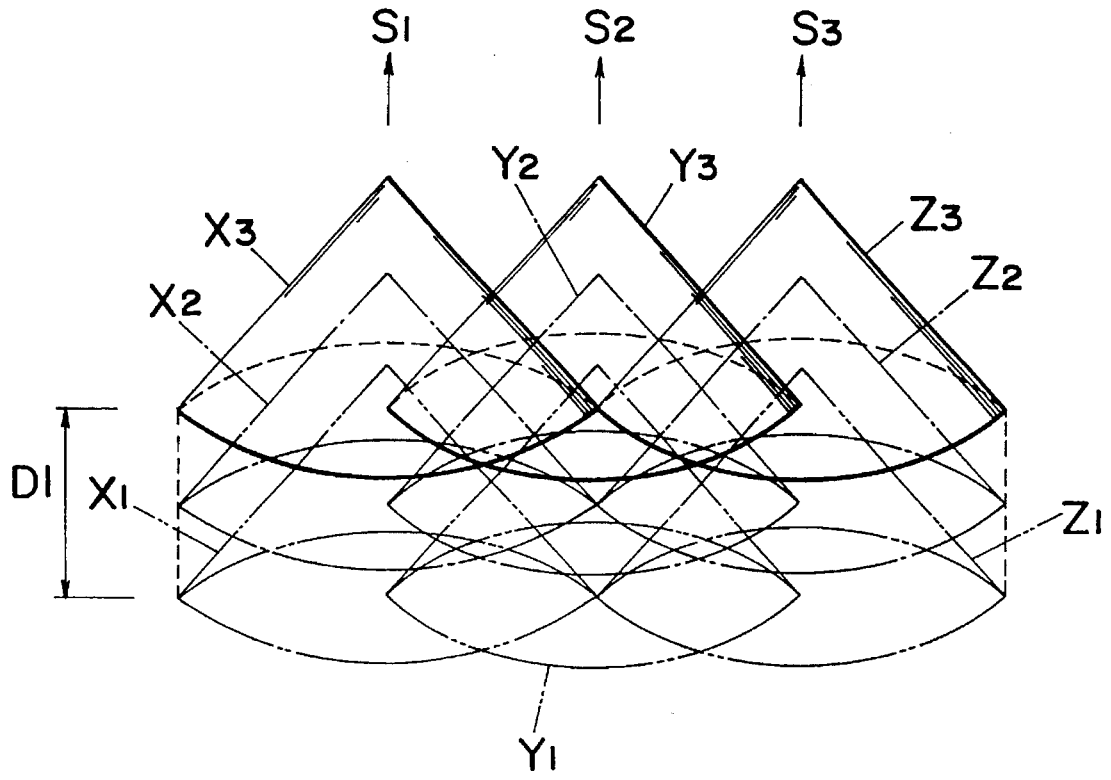
FIG. 29 is an explanatory diagram showing a plurality of stirring and mixing ranges for when a consolidating fluid is jetted from a second nozzle of each of augur shafts while rotating the augur shafts.
Figure 30:
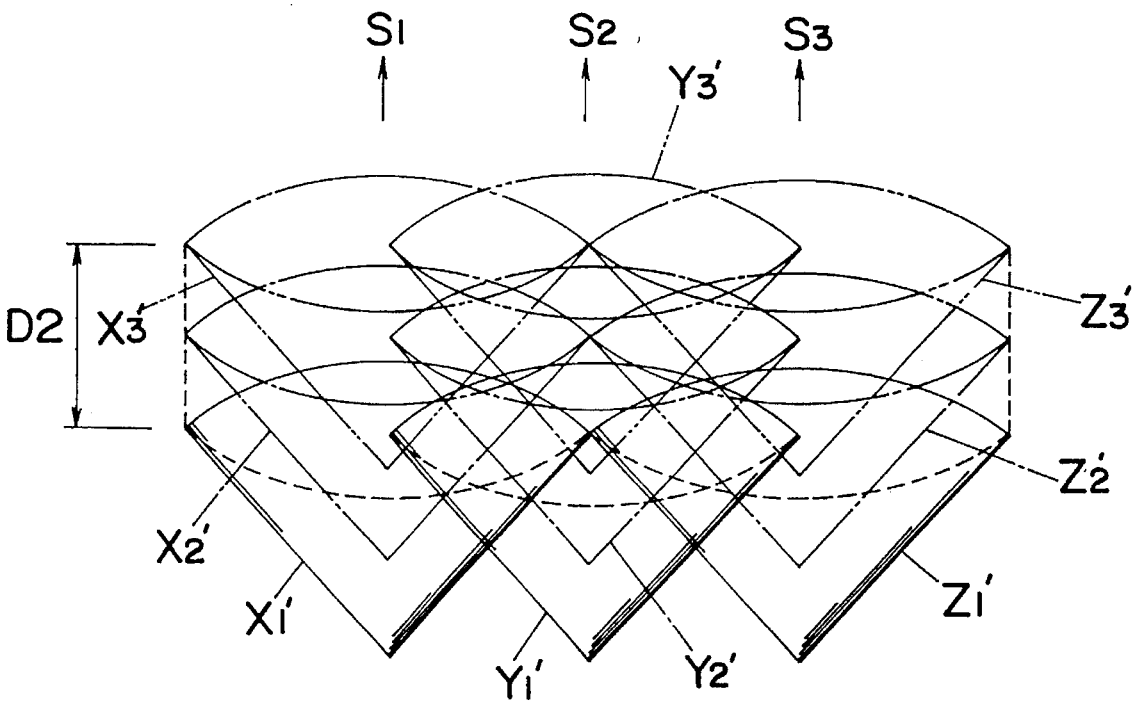
FIG. 30 is an explanatory diagram showing a plurality of stirring and mixing ranges for when a consolidating fluid is jetted from a first nozzle of each of augur shafts while rotating the augur shafts.
Figure 31:
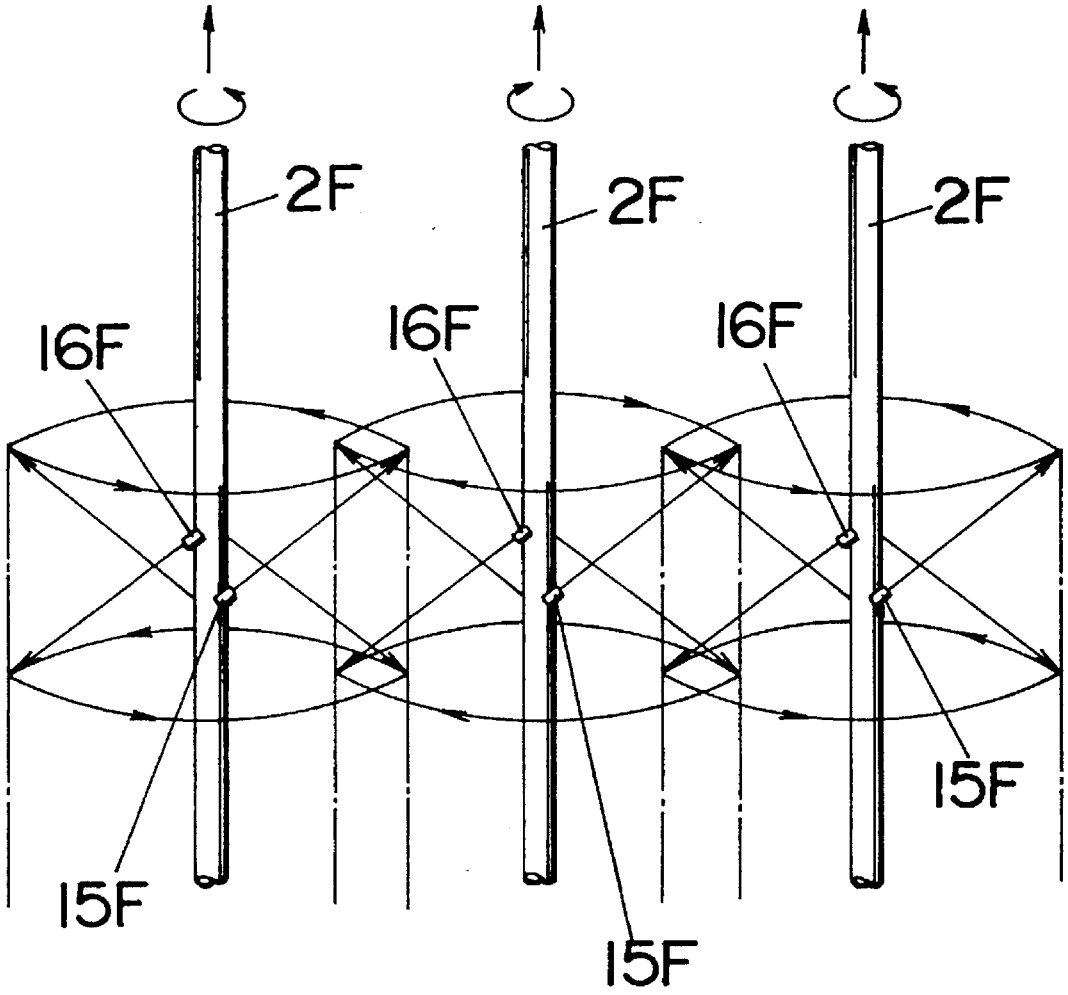
FIG. 31 is an explanatory diagram showing a plurality of stirring and mixing ranges for when a consolidating fluid is jetted from the first and second nozzles of each of augur shafts while rotating the augur shafts.

A stirring and mixing range obtained during a withdrawing step of a plurality of augur shafts is explained below. For example, as shown in FIG. 29, when three auger shafts S1 to S3 are rotated while jetting a consolidating fluid diagonally downward from second nozzles thereof, a trace of the consolidating fluid jetted from the second nozzle of each of the augur shafts is in an approximately conical shape and partially overlapped with a trace of the consolidating fluid jetted from the second nozzle of the adjacent augur shaft. In the withdrawing step, as the auger shafts are withdrawn for a distance D1 upwardly while rotating the augur shafts and jetting the consolidating fluid from the second nozzles, three-dimensional (approximately conically shaped) stirring and mixing ranges of the augur shafts S1 to S3 shift from X1 to X3, from Y1 to Y3, and from Z1 to Z3, respectively, as shown in FIG. 29. In this case, since the jetting of the consolidating fluid transports a part of excavated soil from a vertex portion of the conically shaped stirring and mixing range to a base edge portion of the stirring and mixing range, and also the adjacent stirring and mixing ranges are partially overlapped each other, it is possible to perform an effective stirring and mixing of the consolidating fluid and the soil during the withdrawing step. On the other hand, when the auger shafts S1 to S3 are rotated while jetting the consolidating fluid from first nozzles thereof, a trace of the consolidating fluid jetted from the first nozzle of each of the augur shafts is in an approximately upside-down conical shape, and partially overlapped with a trace of the consolidating fluid jetted from the first nozzle of the adjacent augur shaft. As the auger shafts are withdrawn for a distance D2 upwardly while rotating the augur shafts and jetting the consolidating fluid from the first nozzles, three-dimensional (approximately upside-down conically shaped) stirring and mixing ranges of the augur shafts S1 to S3 shift from X'1 to X'3, from Y'1 to Y'3, and from Z'1 to Z'3, respectively, as shown in FIG. 30. A stirring and mixing effect of this case is substantially same as the above explained effect with respect to the consolidating fluid jetted from the second nozzles. In particular, when the augur shafts are rotated while jetting the consolidating fluid from the first and second nozzles, a more effective stirring and mixing can be performed because the conically shaped ranges are partially overlapped with the upside-down conically shaped ranges, as shown in FIG. 31.

Figure 32:
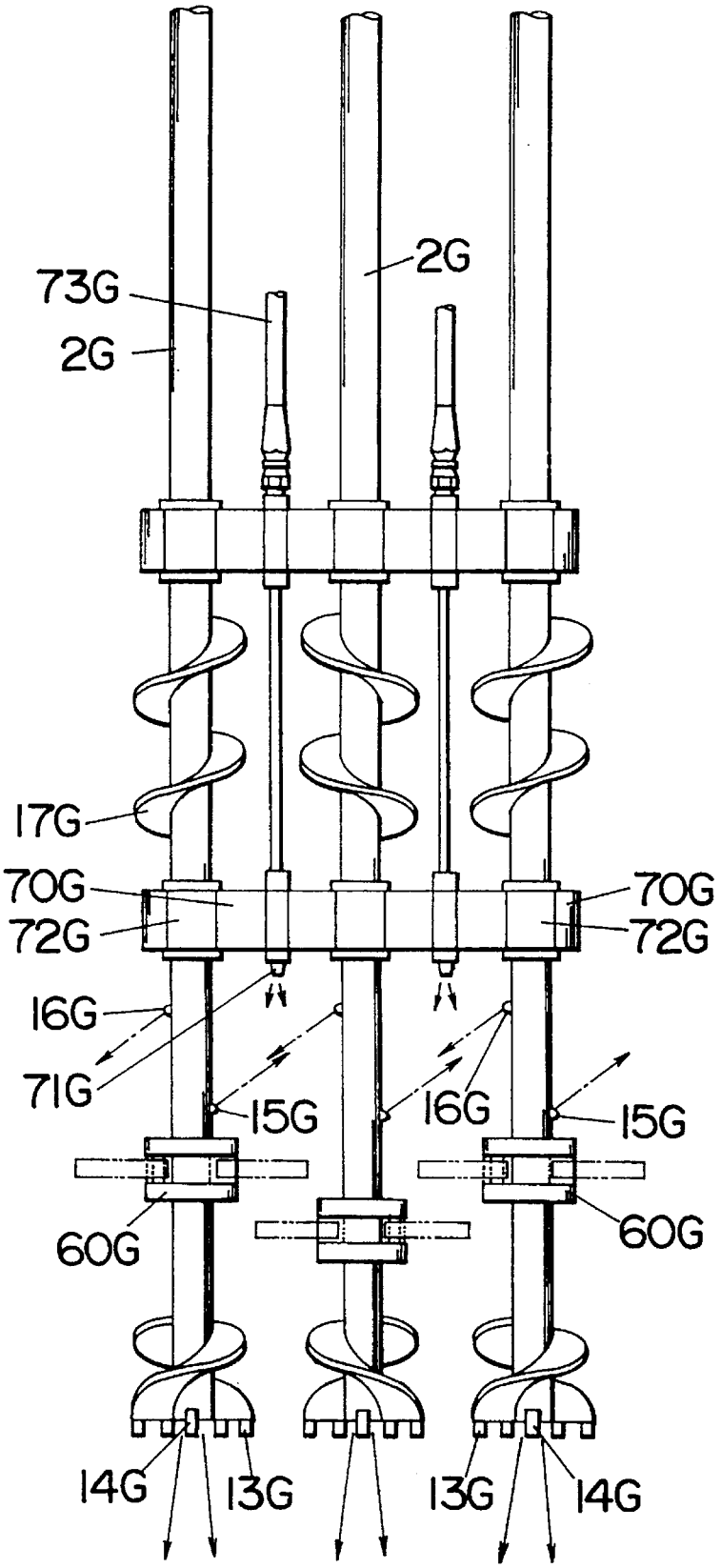
FIG. 32 is an enlarged front view of a plurality of augur shafts each of which has a folding stirrer.
Figure 33A:
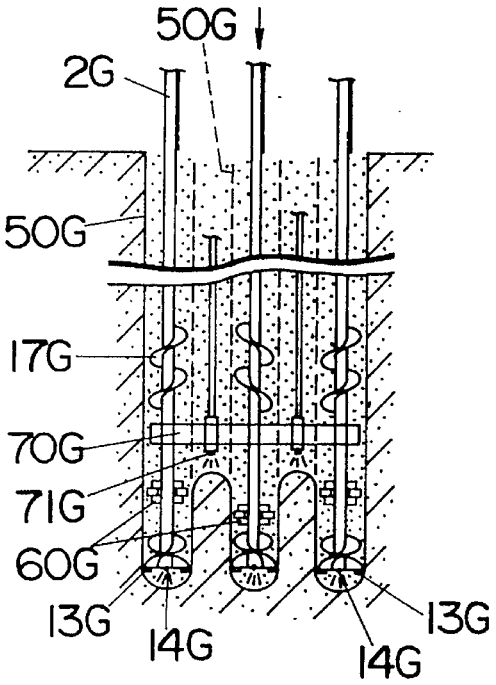
FIGS. 33A to 33D show a process of forming a modified ground wall in the earthen foundation by using the augur shafts of FIG. 32 according to the present invention.
Figure 33B:
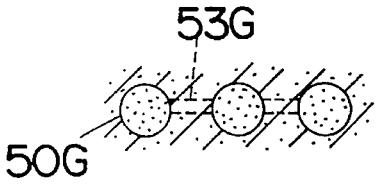
Figure 33C:
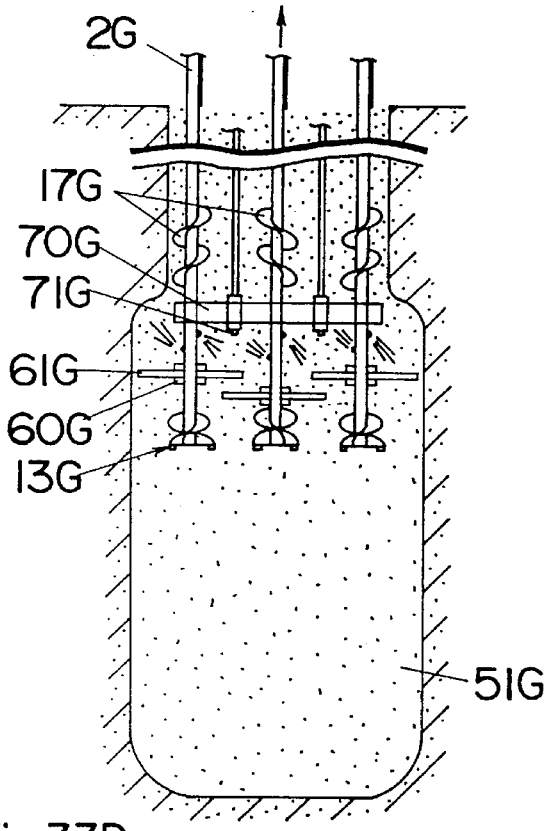
Figure 33D:
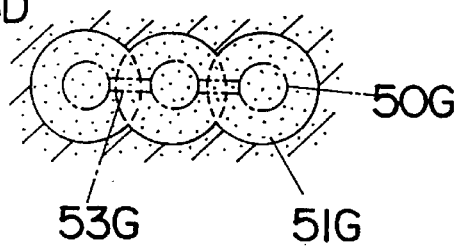

It is preferred to use an excavator having a plurality of augur shafts 2G each of which further includes a folding stirrer 60G, as shown in FIG. 32. Of course, it is possible to use any one of the above explained folding stirrers (60, 60A and 60B) as the folding stirrer 60G. Arrows drawn in FIG. 32 designate jetting directions of consolidating fluid and fluid. A radius of gyration of the folding stirrer 60G in a folded form thereof is determined such that each of holes 50G formed during an excavated step is not overlapped with the adjacent hole, as shown in FIGS. 33A and 33B. On the other hand, as shown in FIGS. 33C and 33D, a radius of gyration of the folding stirrer 60G in an expanded form thereof is determined such that each of modified ground pillars formed by the augur shafts 2G during a withdrawing step is overlapped with the adjacent ground pillar to form a modified ground wall 51G. Of course, for preventing a collision of stirring rods 61G of the adjacent folding stirrers 60G during the withdrawing step, each of the folding stirrers 60G is disposed on the augur shaft 2G so as to stay away from the adjacent folding stirrer axially of the augur shaft 2G, as shown in FIG. 33C.

Figure 34:
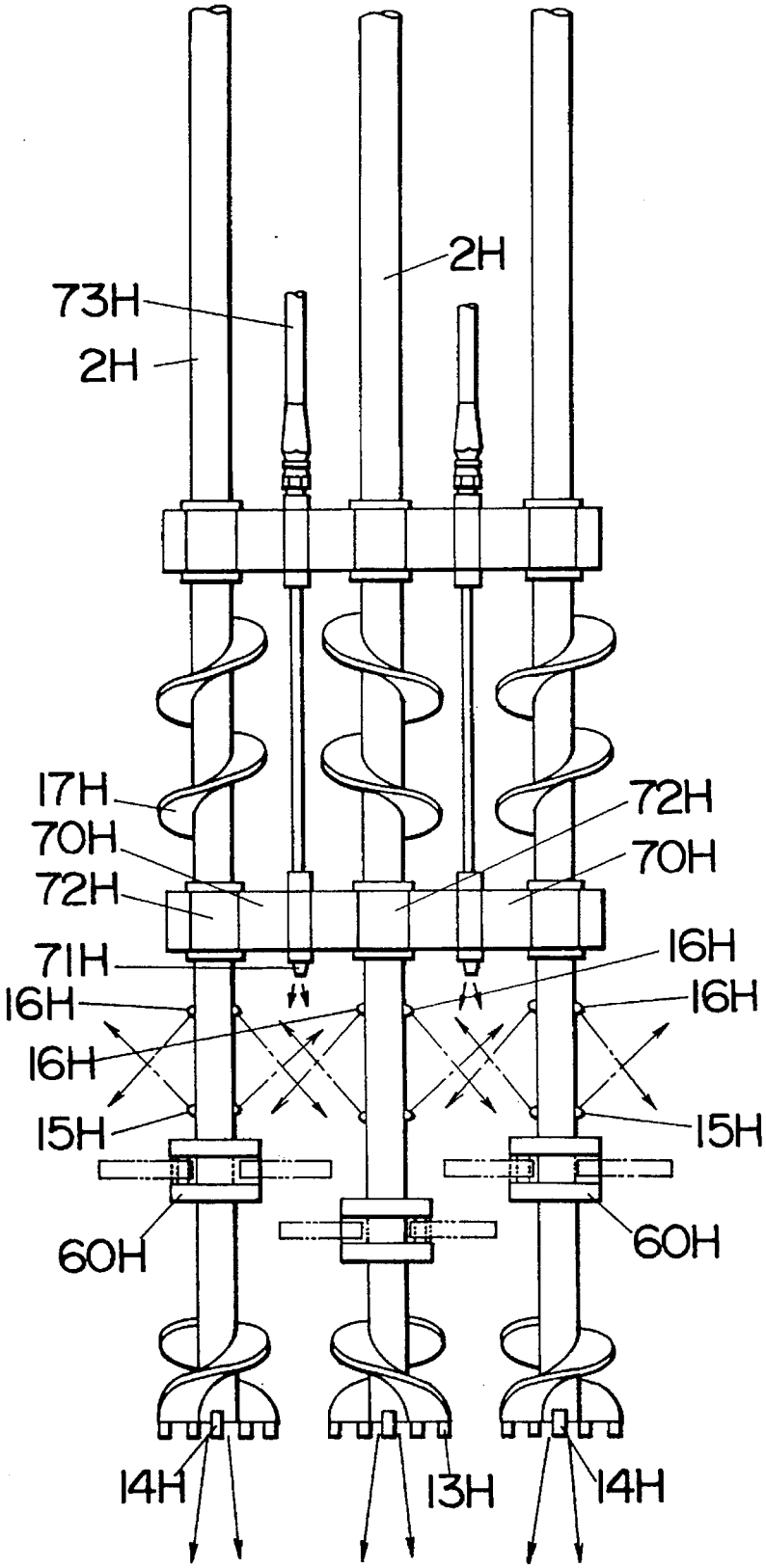
FIG. 34 is an enlarged front view of a plurality of augur shafts each of which has a folding stirrer and a plurality of first and second nozzles.

By the way, in response to a character of an earthen foundation as a planned site of a modified ground wall, it is possible to use an excavator having a plurality of augur shafts each of which has optimum components selected from at least one first nozzle for jetting a consolidating fluid in an upwardly diagonal direction with respect to the axis of the augur shaft, at least one second nozzle for jetting the consolidating fluid in a downwardly diagonal direction with respect to the axis of the augur shaft, at least one third nozzle for jetting the consolidating fluid in a perpendicular direction to the axis of the augur shaft, a bottom nozzle for jetting a fluid downwardly therefrom, a spiral screw extending around the augur shaft, and an expandable stirrer. For example, as shown in FIG. 34, each of three augur shafts 2H includes a plurality of first and second nozzles (15H and 16H), a folding stirrer 60H, a spiral screw 17H, a bottom nozzle 14H and a bit 13H.

For improving strength of a modified ground pillar or wall of the present invention, it is preferred to jet a consolidating fluid including a reinforcing fiber into the earthen foundation. The fiber is selected from a steel fiber, a synthetic resin fiber, and a mixture thereof, etc. For example, length and diameter of the reinforcing fiber are selected from the ranges of 3 to 6 cm, and 0.3 to 1.5 mm, respectively.

Finally, a method of forming a modified ground pillar having a long length thereof in an earthen foundation is explained. Of course, the method can be similarly applied in case of forming a modified ground wall with the use of an excavator having a plurality of auger shafts in the earthen foundation. For example, the above explained excavator 1 is used in this case. An excavating step for forming a deep hole in the earthen foundation substantially consists of a plurality of excavating cycles. That is, in a first excavating cycle, the auger shaft 2 is advanced into the earthen foundation while rotating the augur shaft 2 by moving the movable housing 4 downwardly from the top end position of the vertical travel "Y" to the bottom end position thereof, so that a first hole having a first depth corresponding to the vertical travel "Y" is formed in the earthen foundation. After the first excavating cycle, the chucking of the auger shaft 2 with the main chucking device 30 is released, the movable housing 4 is backed to the top end position of the vertical travel "Y" without varying a position of the auger shaft 2 in the first hole, and the auger shaft is chucked again with the main chucking device 30. The first hole is further excavated in accordance with the substantially same manner as the first excavating cycle to form a second hole having a second depth that is twice as deep as the first depth. Therefore, the deep hole having a predetermined depth is formed in the earthen foundation by repeating the above explained excavating cycle the necessary times.

After the excavating step, a withdrawing step substantially consisting of a plurality of withdrawing cycles is performed to form the modified ground pillar in the earthen foundation. That is, in a first withdrawing cycle, the auger shaft 2 is withdrawn away from the bottom of the deep hole while rotating the augur shaft and jetting the consolidating fluid by moving the movable housing 4 upwardly from the bottom end position of the vertical travel "Y" to the top end position thereof, so that a first modified ground portion, which has a larger diameter than the deep hole and a first length corresponding to the vertical travel, is formed in the deep hole. The chucking of the auger shaft 2 with the main chucking device 30 is released when the movable housing 4 is positioned at the top end position of the vertical travel "Y". In this time, since the auger shaft 2 is chucked with the auxiliary chucking device 40 in place of the main chucking device 30, a subsidence of the auger shaft 2 into the first modified ground portion is prevented. After the movable housing 4 is backed to the bottom end position of the vertical travel "Y" without varying a position of the auger shaft on the first modified ground portion, the auger shaft 2 is chucked again with the main chucking device 30, and released from the auxiliary chucking device 40. Then, the auger shaft 2 is further withdrawn in accordance with the substantially same manner as the first withdrawing cycle to form a second modified ground portion on the first modified ground portion. By repeating such a withdrawing cycle the necessary times, the modified ground pillar is formed in the earthen foundation.

In the past, an excavator capable of moving a movable housing for a long vertical travel along a tower thereof has been often used for forming a deep hole in an earthen foundation. Since the weight of the movable housing is generally much heavy, there has been a danger of a lateral tumble of the excavator when the movable housing is moved to a top end position of the long vertical travel. However, in the above explained method of the present invention, it is possible to safely and readily form a long modified ground pillar or wall in the earthen foundation.

What is claimed is:

1. A method of forming a modified ground in an earthen foundation by an excavator having at least one rotary shaft, said rotary shaft including excavating means on a lower end thereof and nozzle means for jetting a consolidation fluid, said nozzle means being disposed upwardly of said excavating means, and including at least two of a first nozzle for jetting said consolidating fluid in an upwardly diagonal direction with respect to the axis of said rotary shaft, a second nozzle for jetting said consolidating fluid in a downwardly inclined direction with respect to the axis of said rotary shaft and a third nozzle for jetting said consolidating fluid in a direction perpendicular to the axis of said rotary shaft, said method comprising the steps of:

excavating the earthen foundation with said excavating means to form therein a hole by rotating said rotary shaft without jetting said consolidating fluid from said nozzle until said hole is excavated to reach a predetermined depth; and withdrawing said rotary shaft away from the bottom of said hole while rotating said rotary shaft and jetting said consolidating fluid from said nozzle means against soil surrounding said hole to break the same for enlarging the diameter of said hole in such a manner as to perform an in-situ mixing and stirring of said consolidating fluid and soil, to form said modified ground having a larger diameter than said hole, wherein said consolidating fluid is jetted from at least two of said first to third nozzles such that a trace of said consolidated fluid jetting from one of said nozzles crosses with a trace of said consolidating fluid jetting from another of said nozzles.

2. A method as set forth in claim 1 including the step of mechanically stirring the soil surrounding said holes only during said withdrawing step.

3. A method as set forth in claim 1 including the step of jetting a fluid downwardly into said hole ahead of said rotary shaft during said excavating step to facilitate the progress of said rotary shaft.

4. A method as set forth in claim 1 including the step of simultaneously jetting consolidating fluid from at least two of said nozzles such that streams of the consolidated fluid jetted from the respective nozzles substantially intersect.

5. A method as set forth in claim 4 including the steps of jetting consolidating fluid downwardly from said second nozzle and upwardly from said first nozzle to an extent that the streams from said nozzles substantially intersect.

6. A method as set forth in claim 4 including the steps of jetting consolidating fluid downwardly from said second nozzle and perpendicularly from said third nozzle to an extent that the streams from said nozzles substantially intersect.

7. A method as set forth in claim 1 including the step of mechanically transferring a part of an excavated soil to the outside of said hole during said excavating step.

8. A method as set forth in claim 1 including the step of mixing consolidating fluid with a reinforcing filler for mixed jetting from said nozzle means.

9. A method according to claim 1 including the steps of advancing said rotary shaft along said hole during said excavating step and retracting said rotary shaft along said hole during said withdrawal step in stages while maintaining the rotation of said shaft.

10. A method according to claim 1 in which said excavator includes a plurality of rotary shafts and a connecting member rotatably supporting said rotary shafts, including the step of jetting fluid downwardly from said connecting member into said earthen foundation during the excavation step.

11. A method as set forth in claim 1, wherein the trace of said consolidating fluid jetting from said first nozzle crosses with the trace of said consolidating fluid jetting from said second nozzle.

12. A method as set forth in claim 1, wherein the trace of said consolidating fluid jetting from said third nozzle crosses with the trace of said consolidating fluid jetting from said second nozzle.

* * * * *